US007354081B2

(12) United States Patent
Kondratuk

(10) Patent No.: US 7,354,081 B2
(45) Date of Patent: Apr. 8, 2008

(54) SINGLE BOLT MORTISE LOCK

(75) Inventor: Michael Kondratuk, Brookings, SD (US)

(73) Assignee: Hardware Specialties, Inc., Spooner, WI (US)

( * ) Notice: Subject to any disclaimer, the term of this patent is extended or adjusted under 35 U.S.C. 154(b) by 0 days.

(21) Appl. No.: 10/285,808

(22) Filed: Nov. 4, 2002

(65) Prior Publication Data

US 2004/0084909 A1 May 6, 2004

(51) Int. Cl.
*E05C 1/12* (2006.01)
*E05B 3/00* (2006.01)

(52) U.S. Cl. ..... 292/169; 292/159; 292/165; 292/170; 292/336.3; 70/141; 70/144

(58) Field of Classification Search ..... 292/169, 292/169.14, 159, 336.3, 165, 170, 169.12, 292/169.15, 169.17, 1, 2, 32; 70/141, 144, 70/467, 472, 476, 479, 480, 482
See application file for complete search history.

(56) References Cited

U.S. PATENT DOCUMENTS

| | | | | | |
|---|---|---|---|---|---|
| 483,318 | A | | 9/1892 | Armstrong | |
| 945,276 | A | * | 1/1910 | Jenks | 70/216 |
| 1,037,588 | A | | 9/1912 | Brown | |
| 1,173,007 | A | | 2/1916 | Leusley | |
| 1,205,249 | A | | 11/1916 | Newcome | |
| 1,375,287 | A | | 4/1921 | Gjukic | |
| 1,554,839 | A | | 9/1925 | Brown | |
| 1,733,442 | A | | 10/1929 | Bartholomew | |
| 1,855,089 | A | | 4/1932 | Boothe | |
| 2,157,853 | A | | 5/1939 | Heyer | |
| 2,651,934 | A | | 9/1953 | Chesler | |
| 2,803,481 | A | * | 8/1957 | Williams et al. | 292/245 |
| 3,095,724 | A | | 7/1963 | Truhon | |
| 3,621,686 | A | | 11/1971 | Klein | |
| 4,241,888 | A | * | 12/1980 | Bredemus | 292/165 |
| 4,243,256 | A | * | 1/1981 | Frydrych | 292/245 |
| 4,389,061 | A | * | 6/1983 | Foshee | 292/169.14 |
| 4,589,691 | A | * | 5/1986 | Foshee et al. | 292/165 |
| 4,934,800 | A | * | 6/1990 | Choi | 292/172 |
| 4,979,767 | A | * | 12/1990 | Lin | 292/336.3 |
| 4,982,986 | A | * | 1/1991 | Gressett et al. | 292/336.3 |
| 4,988,136 | A | * | 1/1991 | Gressett, Jr. | 292/336.3 |
| 5,083,448 | A | | 1/1992 | Karkkainen et al. | |
| 5,161,837 | A | * | 11/1992 | O'Brien, II | 292/40 |
| 5,342,101 | A | * | 8/1994 | Shih | 292/165 |
| 5,476,295 | A | * | 12/1995 | Smallegan et al. | 292/336.3 |
| 5,492,380 | A | * | 2/1996 | Smallegan et al. | 292/336.3 |
| 5,496,082 | A | * | 3/1996 | Zuckerman | 292/336.3 |
| 5,658,026 | A | * | 8/1997 | Nigro et al. | 292/336.3 |
| 5,678,870 | A | | 10/1997 | Pelletier | |
| 5,695,227 | A | * | 12/1997 | Smallegan et al. | 292/336.3 |
| 5,820,177 | A | * | 10/1998 | Moon | 292/335 |
| 5,865,479 | A | * | 2/1999 | Viney | 292/39 |
| 5,890,385 | A | * | 4/1999 | Lee | 70/472 |
| 6,050,115 | A | * | 4/2000 | Schroter et al. | 70/107 |
| 6,125,670 | A | * | 10/2000 | Fuss et al. | 70/107 |

(Continued)

*Primary Examiner*—Carlos Lugo
(74) *Attorney, Agent, or Firm*—Moss & Barnett, P.A.

(57) ABSTRACT

The present invention comprises a reversible, single bolt mortise lock assembly for hinged doors. The lock assembly combines live bolt and dead bolt functions utilizing only a single bolt. The invention further features a reversible lock assembly that can be opened by rotation of the door handle either clockwise or counterclockwise, and a dual slide lock system.

35 Claims, 29 Drawing Sheets

U.S. PATENT DOCUMENTS 6,138,485 A * 10/2000 Fuss et al. ..... 70/107
6,174,005 B1 * 1/2001 Norton ..... 292/169.21
6,299,222 B1 10/2001 Atmodimedjo
6,302,456 B1 * 10/2001 Errani ..... 292/332
6,349,982 B2 2/2002 Fayngersh et al.
6,393,878 B1 * 5/2002 Fayngersh et al. ..... 70/107
6,478,345 B1 * 11/2002 Viney ..... 292/39
6,491,327 B1 * 12/2002 Fan ..... 292/165
6,536,248 B1 * 3/2003 Fan ..... 70/467
6,540,274 B2 * 4/2003 Bates et al. ..... 292/336.5

* cited by examiner

SINGLE BOLT MORTISE LOCK

FIELD OF INVENTION

The present invention relates to a mortise door latch for doors. The present invention combines live bolt and dead bolt operations into a single bolt and further describes a double slide bolt system.

RELATED ART

Mortise locks typically include both a deadbolt and a live bolt. Deadbolt locks are typically actuated between a locked position and an unlocked position by a rotatably mounted key cam having a follower. For mortise locks, a key cam with follower and a deadbolt are mounted within the edge of a door (the "mortise"), connected to a key cylinder body located on the exterior side of a door and frequently a thumb turn button located on the interior side of the door, all connected by a spindle. Rotation of the key cam (by either a key actuating the key cylinder or by turning the thumb turn button) causes the key cam follower to rotate into engagement with the deadbolt to actuate the deadbolt between a locked position (extended from the outer edge of the door into a door jam).and an unlocked position (retracted into the door).

Similarly, the live bolt is actuated by a handle cam secured by a spindle between two handles, one on each side of the door. Rotation of the handle causes the handle cam to engage the live bolt and move it from its locked (extended) position to its unlocked (retracted) position.

The live bolt is required for normal operation of the door; the deadbolt is required for security purposes. This dual lock system adds expense to the cost of a door, not only due to the additional hardware, but the additional machining of the door and door jamb which must be accomplished in order to accommodate the dual lock system. There is therefore a need for a mortise lock that minimizes the expense incurred by a door manufacturer by reducing the hardware required for the door locking mechanism, the time required to prepare a door to accommodate multiple locking mechanisms, and installation time.

It is less aesthetically pleasing to have two locking mechanisms installed on the door. There is a need for a mortise lock that can be fully secured within a door with minimal hardware extending from the exterior of the door for aesthetic purposes.

It is desirable to create a locking mechanism which is simpler to use. With many prior art mortise locks, rotation of the key cam in a specified direction is required to extend the deadbolt. The door operator may not always recall which direction the key cam must be rotated to extend the deadbolt to its locked position. This-can create confusion as to whether the lock has been engaged. There is, therefore, a need for a locking mechanism where it is easy to determine when the lock mechanism has been triggered to engage the deadbolt.

Another issue with prior art mortise locks is lack of reversibility. Mortise locks may be used with doors with either right or left hand hinges. The side on which the door is hinged may require reversal of the mortise lock or flipping of the door. Either of the steps is burdensome. Therefore, there is a need for a mortise lock that is reversible—that can be used with doors with either right or left hand hinges, without flipping the door.

Another issue with mortise locks is the need for adjustability. The distance a deadbolt extends outwardly from the door faceplate and extends into a bore formed in the door jamb (known as "throw") varies. If the doorjamb is not properly prepared and provides too shallow a bore for receiving the deadbolt, the deadbolt may not fully extend. If the deadbolt is actuated by a key cam, the operator may not be able to lock the door, or the operator may not be able to retrieve the key because the deadbolt is not fully extended. Under these circumstances, the operator may attempt to force rotation of key cam to force full extension of the deadbolt, causing the key cam follower to rotate out of engagement with the deadbolt. Because the key cam can no longer engage the deadbolt, the deadbolt remains in an extended, locked position, called "lock out." Thus, there is a need to develop a deadbolt where lock out is prevented.

It is vital that the deadbolt not be retractable when in the extended position except and until by rotation of the thumb turn button or key cam. Thus, there is a need to develop a deadbolt that cannot be unintentionally retracted from its extended position.

BRIEF SUMMARY OF THE INVENTION

The present invention comprises a single bolt mortise lock that may be utilized in a typical door application. The mortise lock is reversible and is small allowing it to be used in most existing door applications. The mortise lock includes a lock body comprised of opposing side plates with a single bolt assembly intermediate the side plates that acts as both a live bolt and a dead bolt.

The single bolt assembly includes a bolt slideably mounted on a slide. The slide is slideably mounted between the side plates to move the single bolt between a retracted (open door) position within the door frame and an extended (locked or door closed) position with the bolt extended beyond the edge of the door. A handle cam is operatively connected to the single bolt assembly, intermediate the side plates. Upon rotation of the handle cam by a handle operatively connected thereto, the cam moves the bolt and slide between its extended and retracted positions.

Also positioned intermediate the side plates is a lock plate including lock tabs. The lock plate is operatively connected to two key cams, rotatably mounted between the side plates. The key cams are located on opposite sides of the handle cam. Upon rotation of either key cam, the lock plate is moved between a locked and an unlocked position. In the unlocked position, the lock tabs align with lock tab channels formed in the single bolt and slide, permitting the bolt to be retracted into the door frame. In the locked position with the bolt extended, the lock tabs do not align with the lock tab channels, preventing retraction of the bolt from its extended position.

A thumb turn button or key cylinders can be secured to either or both key cams. A spindle operatively links the key cams to the thumb turn button or key cylinders. Because these parts are separate, they can be used in doors of varying thickness by only changing the length of the spindle.

These features of novelty and various other advantages that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE INVENTION

The present invention of a single bolt mortise lock will be described as it applies to its preferred embodiment. It is not intended that the present invention be limited to the described embodiment. It is intended that the invention cover all modifications, equivalents and alternatives which may be included within the spirit and scope of the invention.

Figure 1:
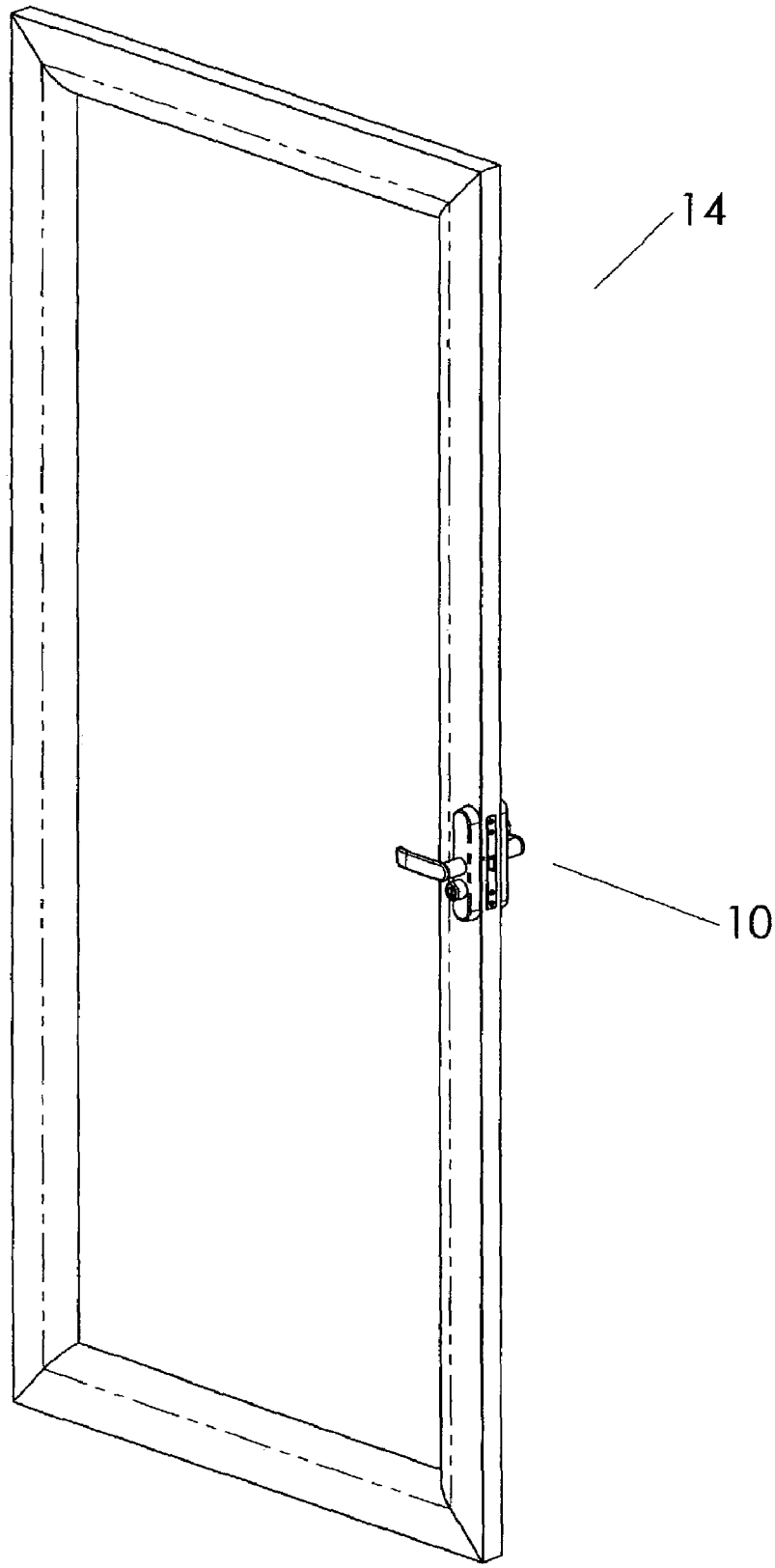
FIG. 1 is a perspective view of a doorframe with the single bolt mortise lock installed thereon.
Figure 2:
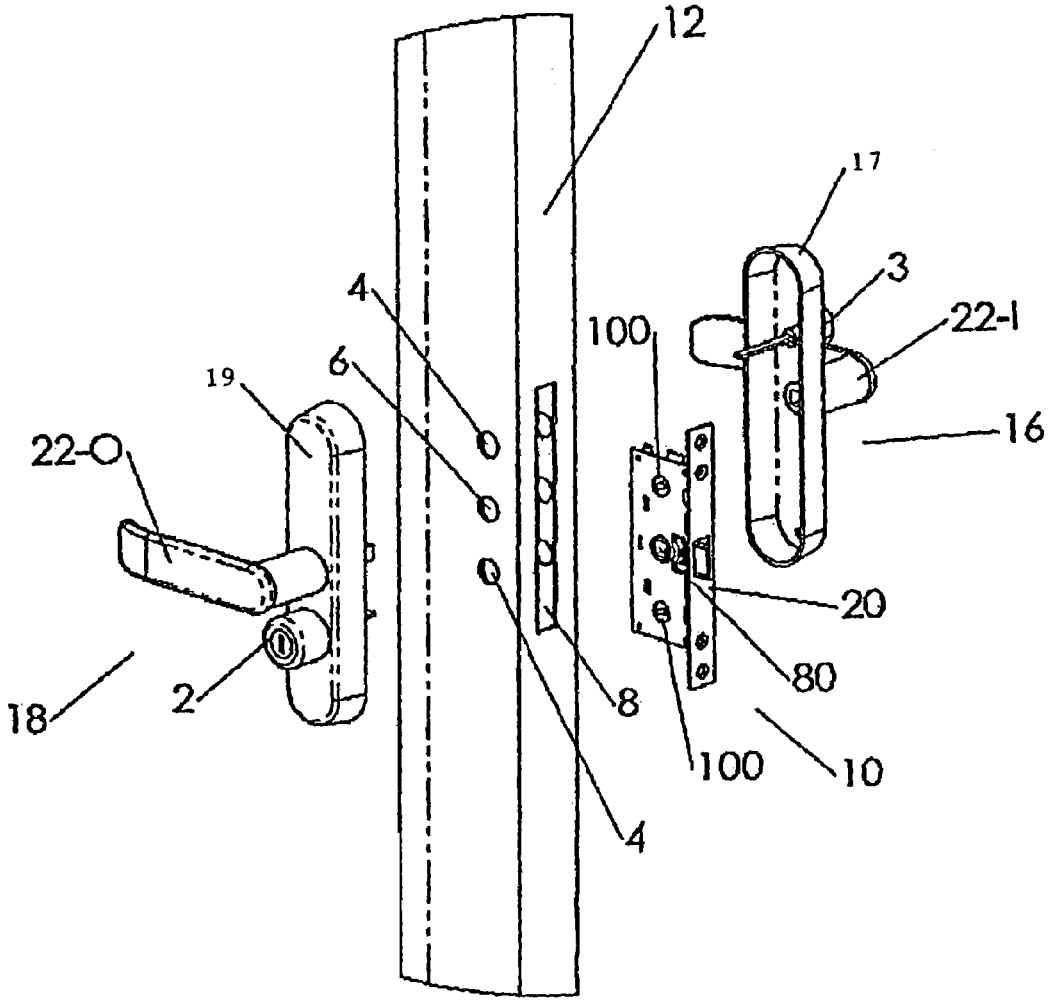
FIG. 2 is an exploded view of a portion of the doorframe indicating how the single bolt mortise lock is secured to the door.

Referring now to the drawings, wherein like reference numerals and letters indicate corresponding structure throughout the several views, and referring in particular to FIGS. 1 and 2, there is shown a single bolt mortise latch assembly 10 according to the present invention. The latch assembly 10 is designed for installation in outer edge 12 of a door 14, and is protected on the inward facing side of the door 14 by an interior escutcheon assembly 16 and protected on the outward facing side of the door 14 by an exterior escutcheon assembly 18. On the door edge 12, the single bolt mortise latch assembly 10 is protected and secured to the door 14 by a mortise plate 20. Handles 22-O and 22-I are secured to the single bolt mortise latch assembly 10 through the escutcheon assemblies 16 and 18. The mortise lock 10 is reversible and also compatible for use with a thinner solid core door.

A properly prepared door, as illustrated in FIG. 2, includes key cam openings 4, a handle opening 6 and a cutout 8 for receiving the single bolt mortise latch assembly 10. Key cam openings 4 should align with key cams 100, and handle cam opening 6 should align with handle cam 80. Because of the uniformity and reversibility of the latch assembly 10, door preparation is identical for either left or right hinged doors.

Figure 4:
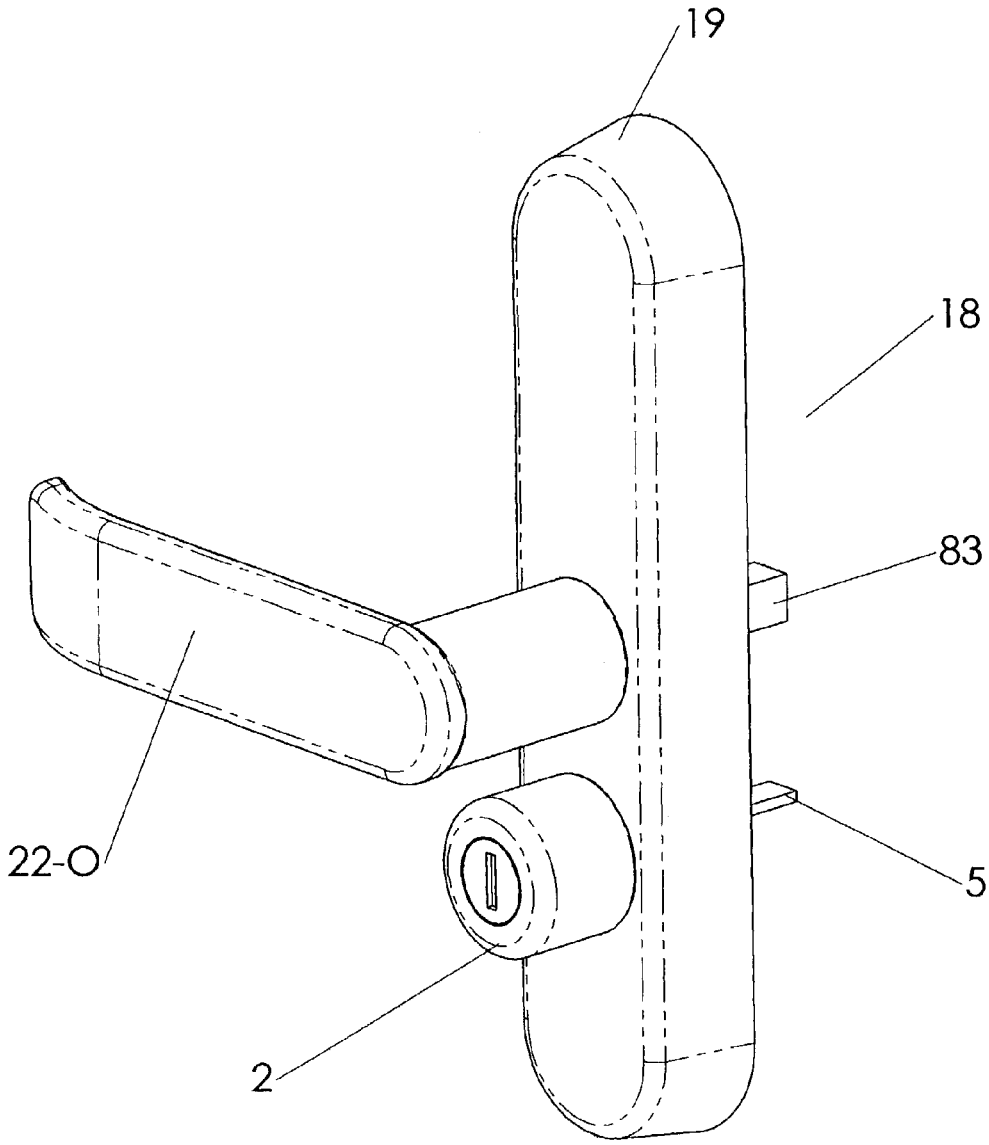
FIG. 4 is an exterior escutcheon assembly, designed to be secured over the single bolt mortise lock on the exterior side of the doorframe, and includes an escutcheon cover plate, handle and key cylinder.

FIG. 4 is an embodiment of the exterior escutcheon assembly 18. Escutcheon assembly 18 includes an escutcheon cover plate 19 which is mounted on the exterior side of the door, over the single bolt mortise assembly 10. Attached to the exterior escutcheon plate 19 is an outside door handle 22-O with its spindle 83 extending inwardly into engagement with the single bolt mortise lock assembly 10, and an optional key cylinder 2 with its spindle 5 extending inwardly into engagement with the single bolt mortise lock assembly 10.

Figure 5:
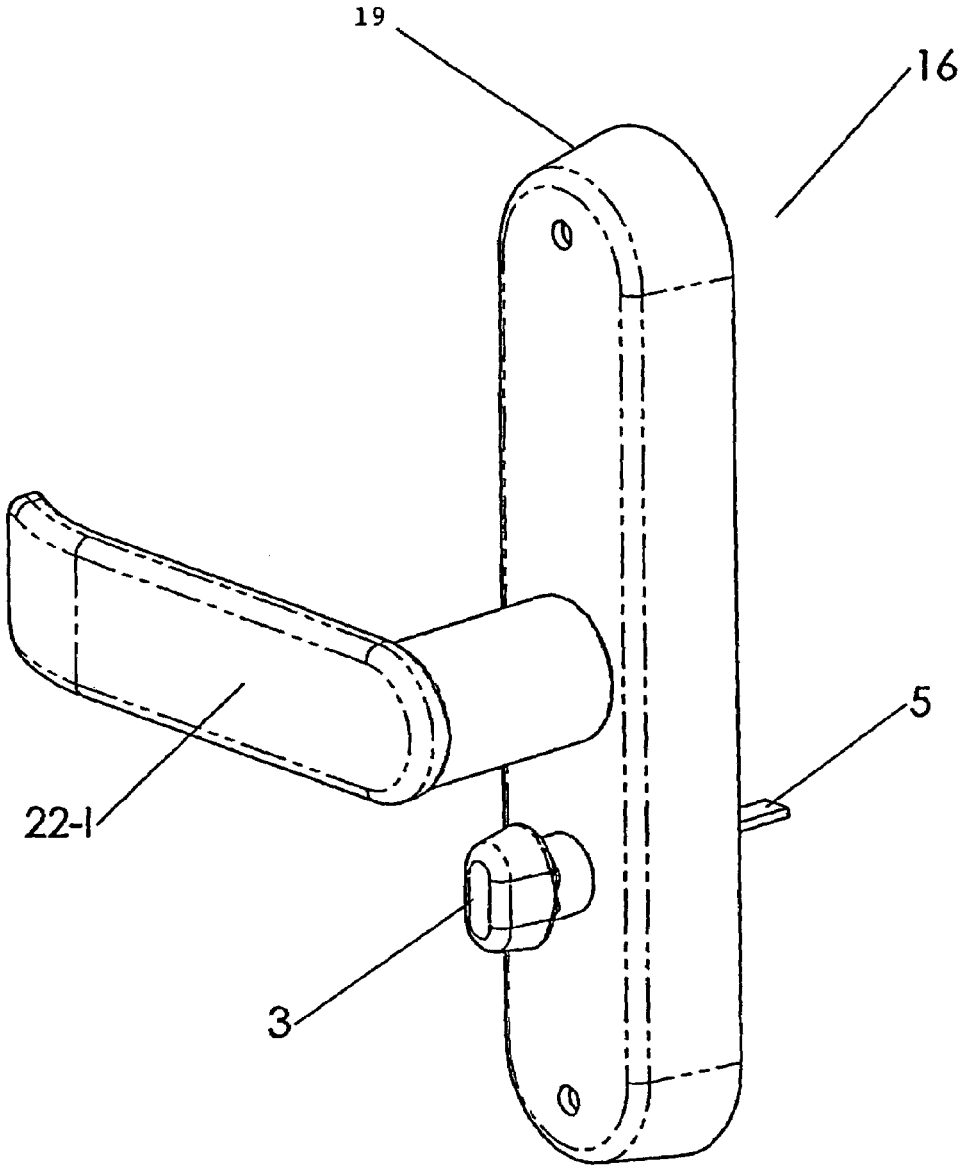
FIG. 5 is an interior escutcheon assembly, designed to be secured over the single bolt mortise lock on the interior side of the doorframe, and includes an escutcheon cover plate, handle and a thumb turn button.

FIG. 5 is an embodiment of the,interior escutcheon assembly 16. This assembly includes an escutcheon cover plate 17 which is mounted on the interior side of the door, over the single bolt mortise assembly 10. Attached to the interior escutcheon plate 17 is an inside door handle 22-I, and a thumb turn button 3 with its spindle 5 extending inwardly into engagement with the single bolt mortise lock assembly 10.

Figure 6:
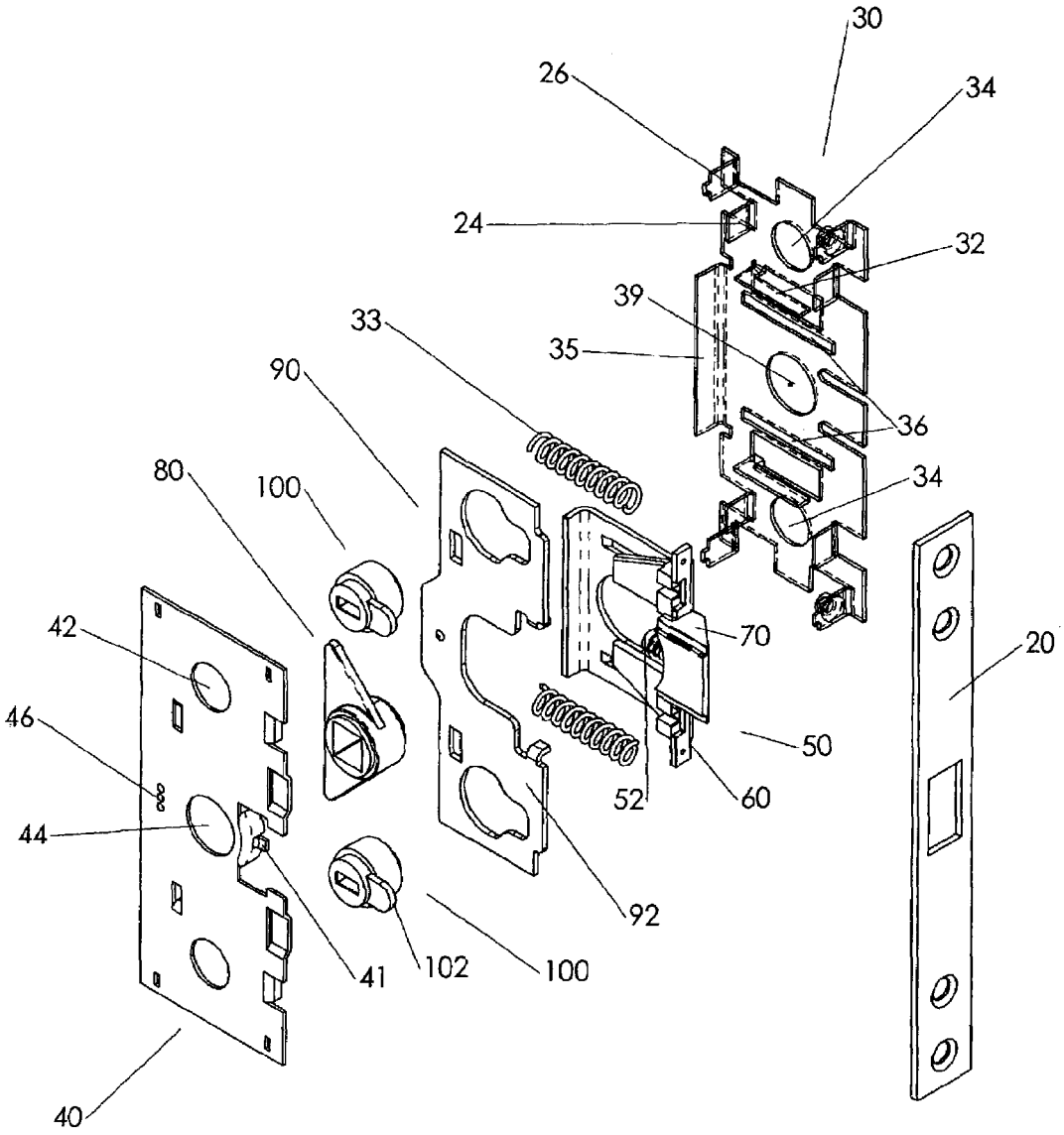
FIG. 6 is an exploded perspective view of the single bolt mortise lock.

The spindle 5 on thumb turn button 3 extends through the single bolt mortise lock assembly 10 and can extend into engagement with key cylinder 2. The key cylinder 2 and thumb turn button 3 do not need to be axial aligned and in this condition, a spindle 5 would extend from each of the key cylinder 2 and the thumb turn button 3 to a corresponding key cam 100 (FIG. 6). This allows the key cylinder 2 to be positioned below the handle 22 while the thumb turn button 3 is above the handle 22 (or vice versa).

Figure 26:
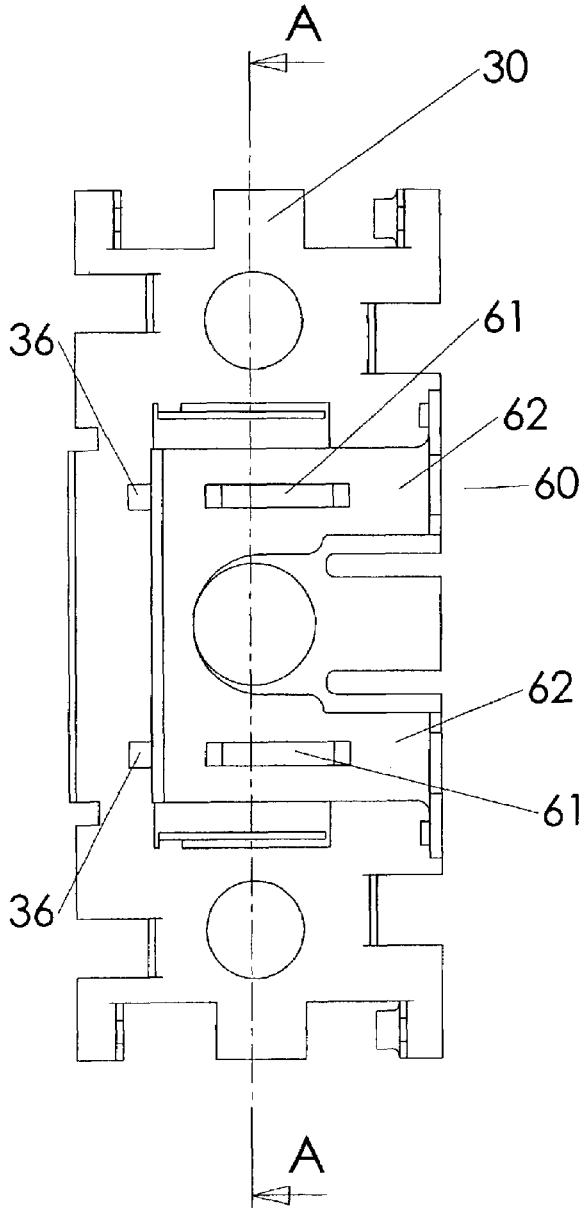
FIG. 26 is a side view of the base plate and slide interconnection.
Figure 27:
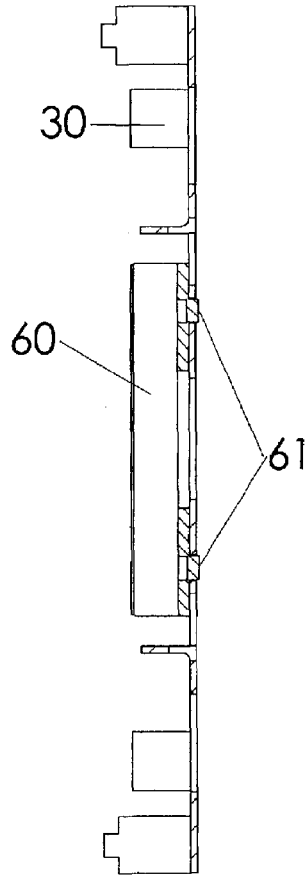
FIG. 27 is a section view of the base plate and slide interconnection along the line A-A of FIG. 26.

Referring now to FIGS. 6-11, the single bolt mortise latch assembly 10 includes a lock body or housing formed by opposed side plates (base plate 30 and cover plate 40), a bolt assembly 50 intermediate the base plate 30 and cover plate 40 that acts as both a live bolt and a dead bolt, and a lock plate assembly 90 positioned intermediate base plate 30 and cover plate 40 in engagement with the bolt assembly 50 for securing the bolt assembly 50 in a locked or unlocked position. The base plate 30 and cover plate 40 are spaced apart from each other and are secured to each other by a number of support tabs 24 and engagement tabs 26. These tabs maintain a lock plate 92 in proper alignment with cover plate 40 and base plate 30. Key cam openings 34 are defined in base plate 30 to rotatably receive one end of the key cams 100. Handle cam opening 39 is designed to rotatably receive handle cam 80. Base plate 30 includes a stop plate 35 and guide tracks 36 to control the direction and distance of travel of the bolt assembly 50 when slideably mounted to the base plate 30 as shown in FIGS. 26 & 27. Base plate 30 further includes a protruded stop 38 that extends through an opening 98 in lock plate 92 to engage and limit the movement of the lock plate 92.

Figure 7:
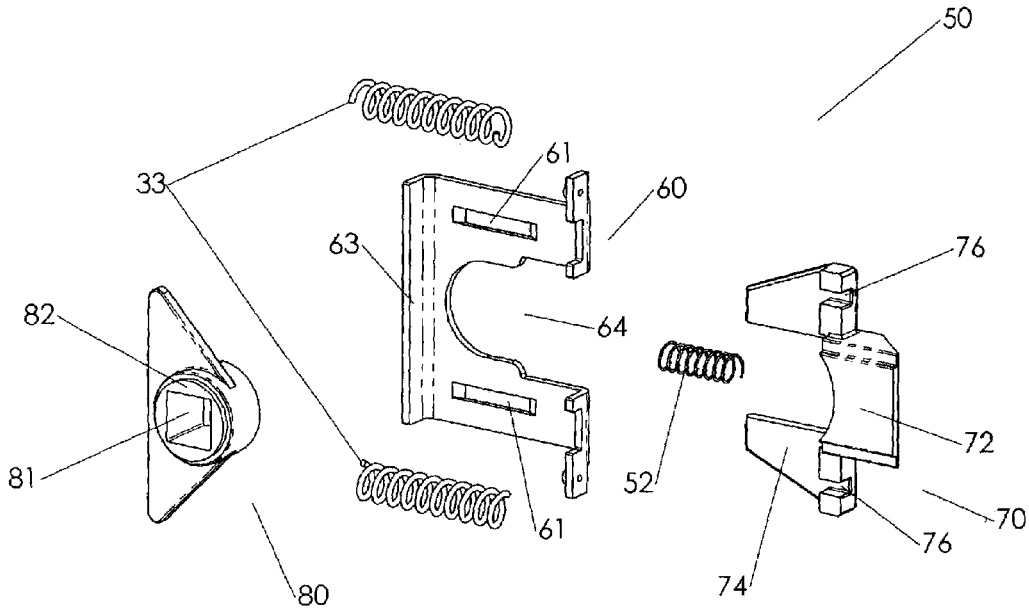
FIG. 7 is an exploded perspective view of the single bolt assembly portion of the single bolt mortise lock.

As shown in FIG. 7, a preferred embodiment of the bolt assembly 50 includes a slide 60, a bolt 70 and a handle cam 80.

Figure 13:
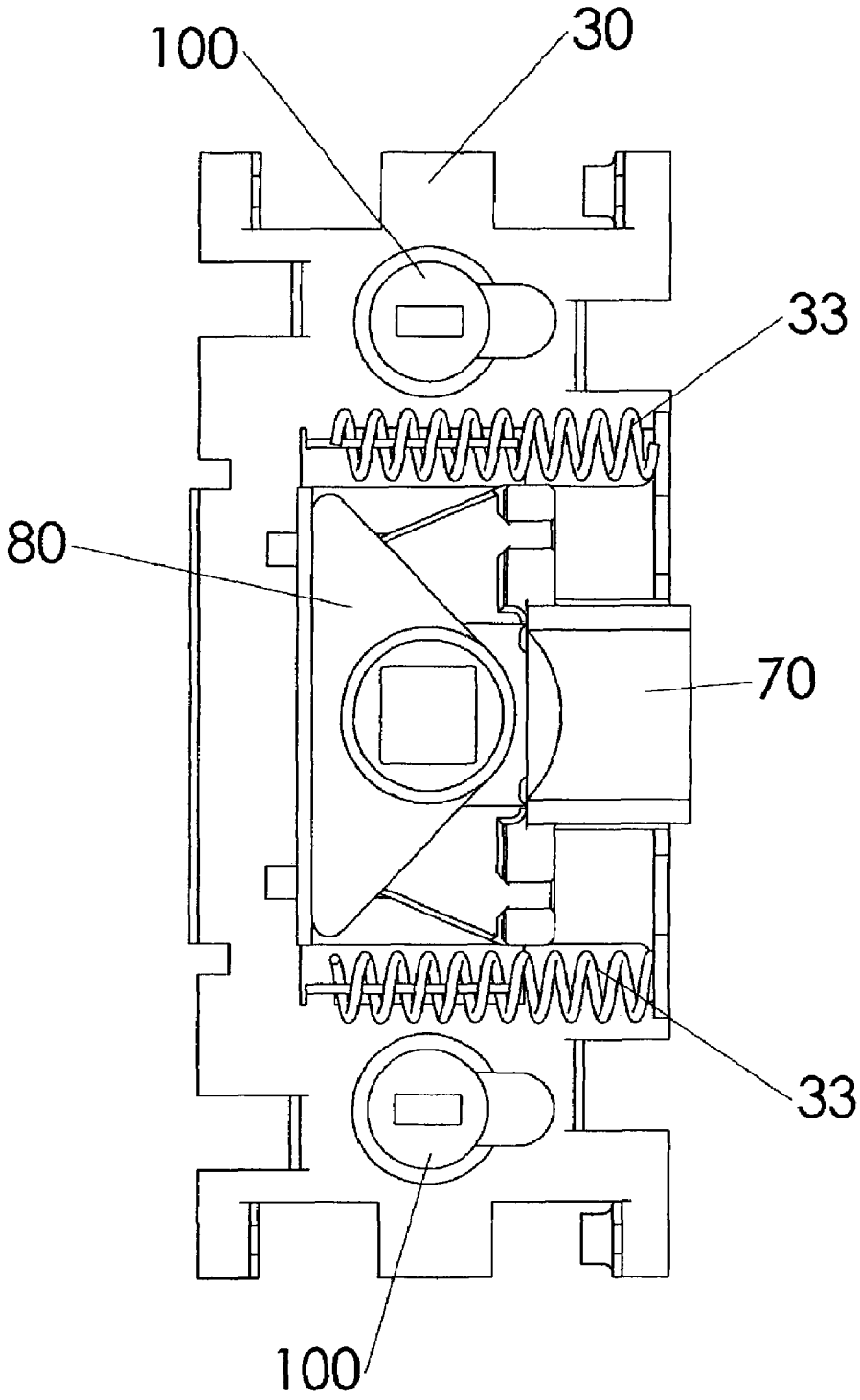
FIG. 13 is a side view of the single bolt mortise lock with the lock plate, cover plate and mortise plate removed, illustrating the alignment of the single bolt mortise lock components when the bolt is in a retracted position.
Figure 15:
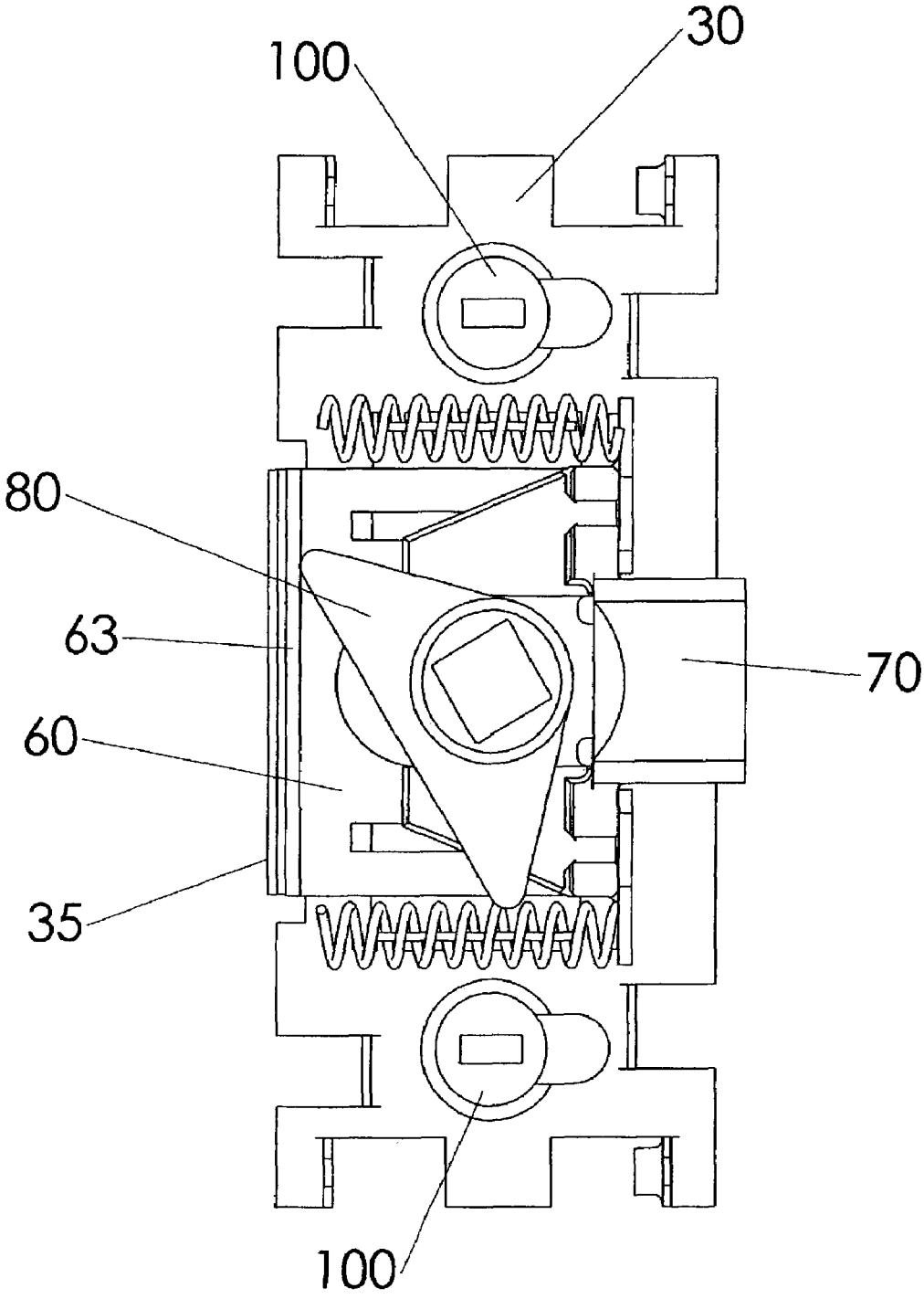
FIG. 15 is a side view of the single bolt mortise lock with the mortise plate, cover plate and lock plate removed, the handle cam rotated into engagement with the slide, and illustrating the alignment of the single bolt mortise lock slide and bolt in the retracted position.
Figure 24:
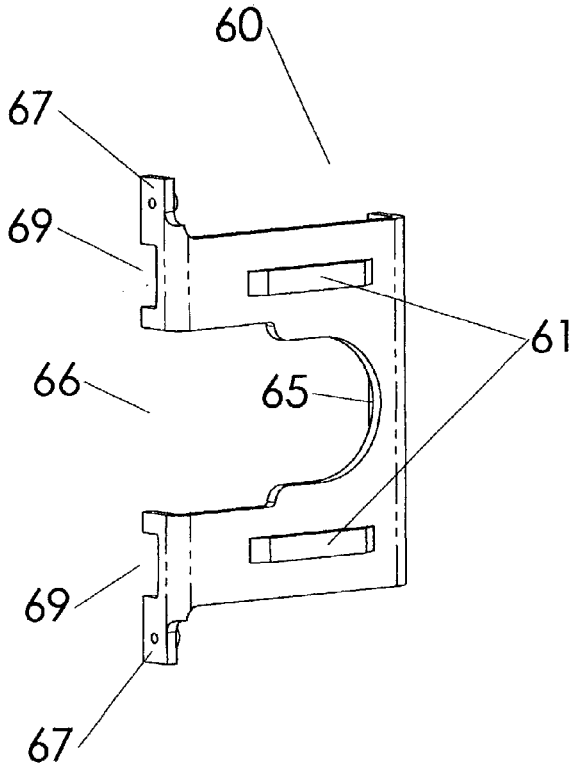
FIG. 24 is a back side perspective view of the slide.

Slide 60 is slideably mounted on the base plate 30 as shown in FIGS. 13 & 15. As illustrated in FIG. 7, slide 60 includes rails 61 protruding outward that engage guide tracks 36 on base plate 30 (FIGS. 24, 26 & 27), permitting transverse movement of the slide 60 with respect to the base plate 30. The "stroke" or length of movement of the slide 60 can be controlled by modifying the length of the guide tracks 36 and rails 61. A strike plate 63 (FIG. 7) on one end of the slide 60 operatively corresponds to stop plate 35 on the base plate 30 to limit travel of the slide 60 with respect to the base plate 30.

Figure 17:
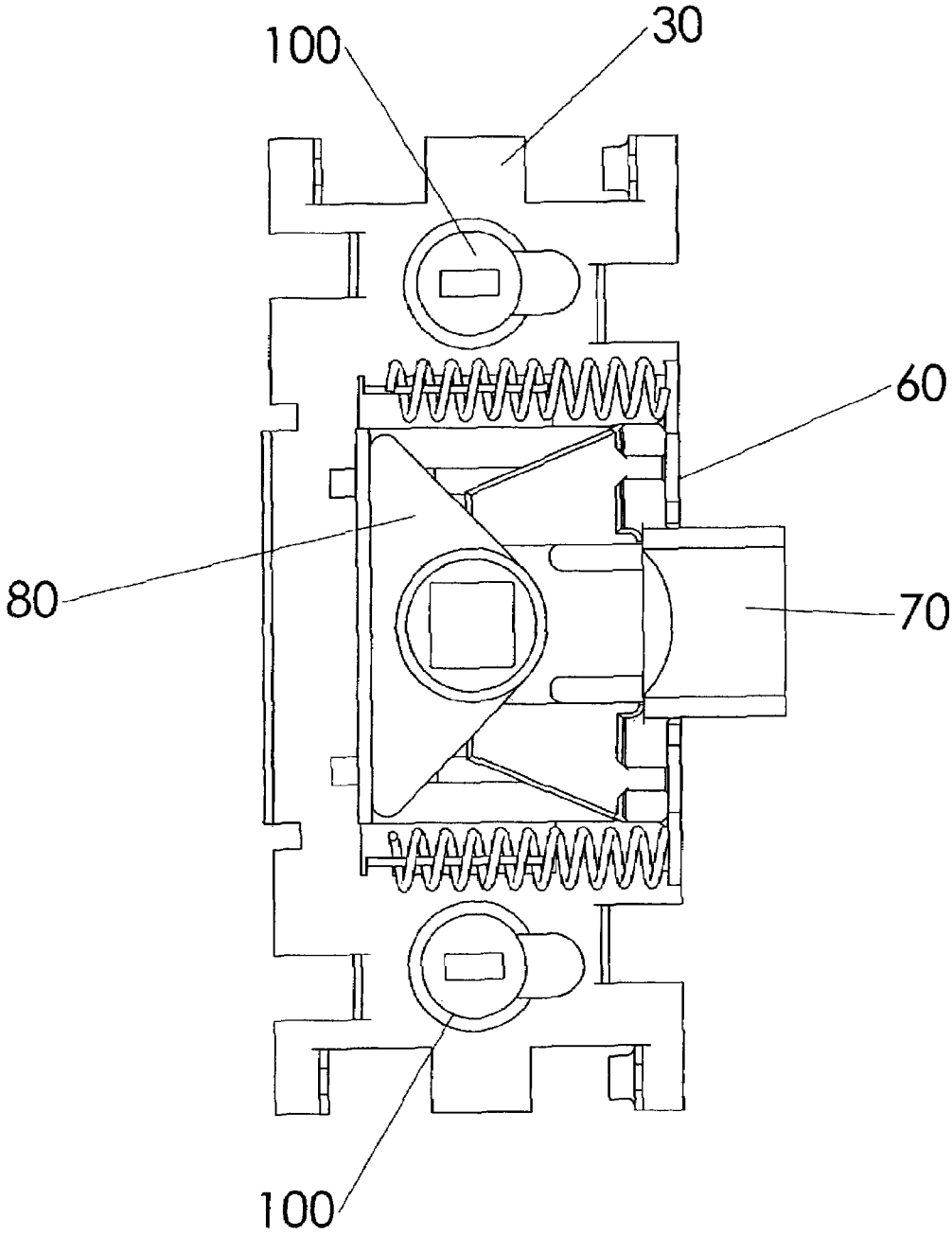
FIG. 17 is a side view of the single bolt mortise lock with the mortise plate, cover plate and lock plate removed, with the single bolt biased into its extended or home position.
Figure 23:
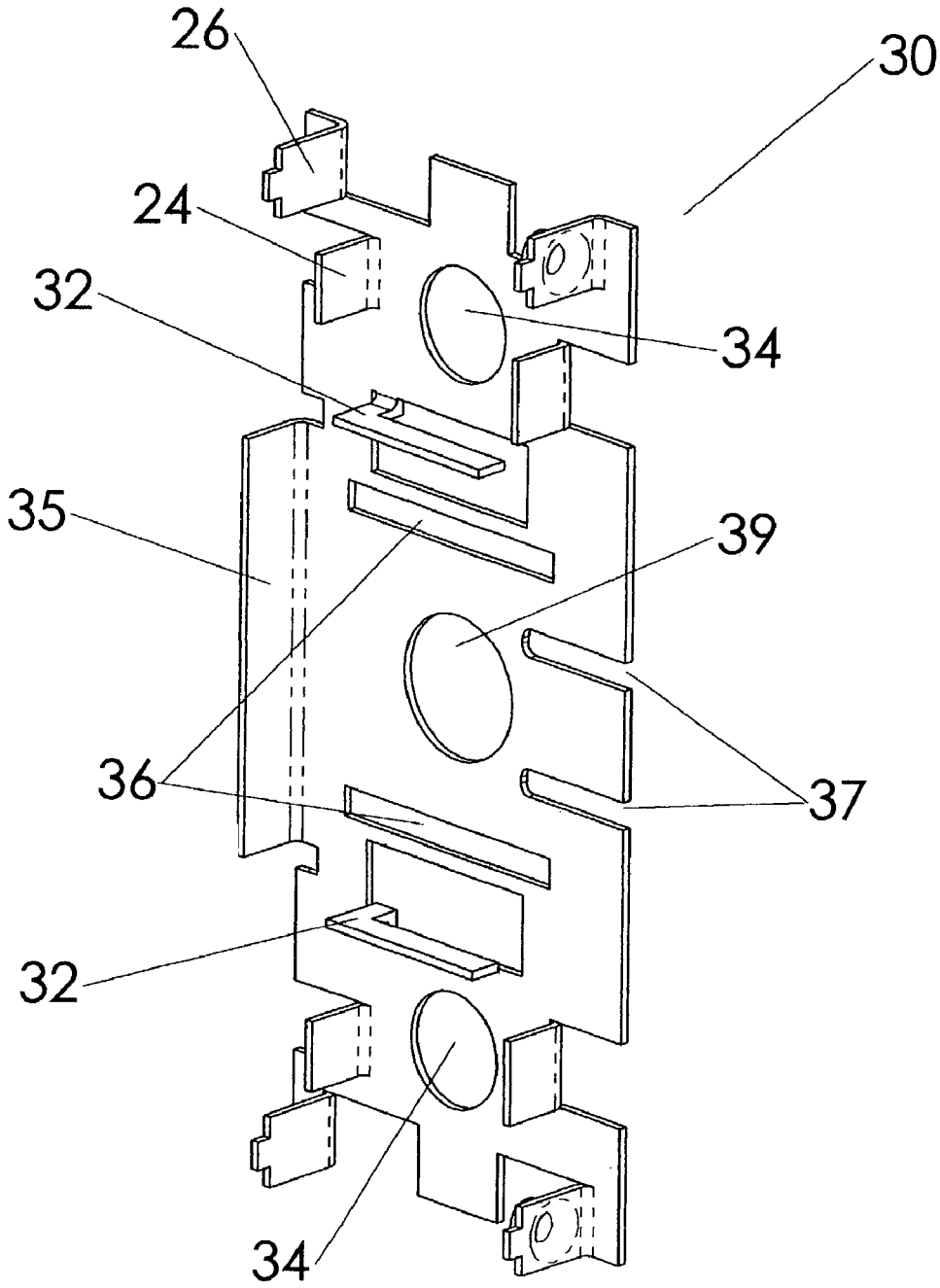
FIG. 23 is perspective view of the base plate.

Spring supports 32 on base plate 30 (FIG. 23) retain coil springs 33 in contact with slide 60 to bias slide 60 in an extended position as shown in FIGS. 13 & 17. Although the preferred embodiment is shown with two coil springs 33, the number and type of mechanisms capable of biasing the slide 60 in its extended position is unlimited. It is preferable that such bias mechanisms be sufficiently stiff to support the slide 60 in its extended position when the weight of handles 22 is added to the single bolt latch assembly 10. Depending on the type of handle used, gravity acting on the handles 22 may tend to cause rotation of the handle cam 80, causing the slide 60 to move. A stiff bias mechanism holds the handles 22 in their proper orientation by preventing undesired movement of the slide 60.

Figure 29:
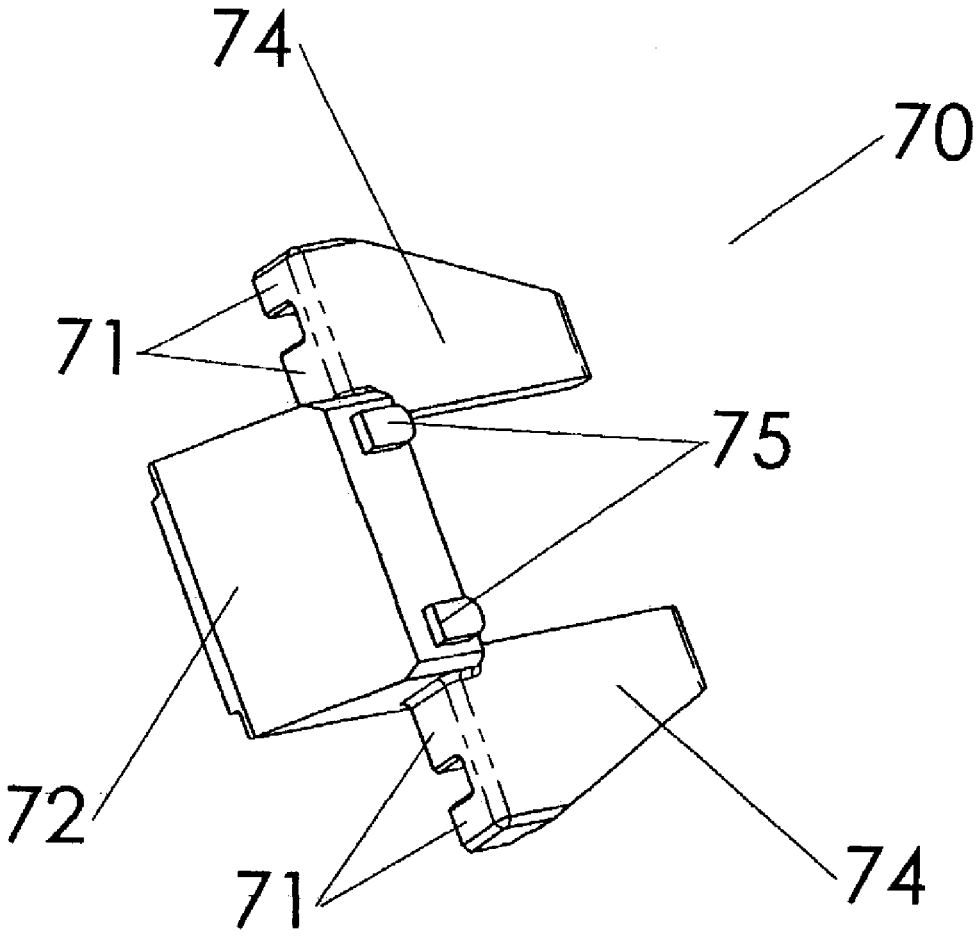
FIG. 29 is a back side view of the bolt illustrating the bolt guides.

Bolt 70 is slideably mounted on the slide plate 60 for movement between a retracted position (FIG. 15) with the bolt withdrawn within the housing and an extended position (FIG. 17) with the bolt extended outward from the edge 12 of door 14. Referring to FIGS. 7 & 29, bolt 70 includes a bolt head 72 for engaging a door jamb, and wings 74 for stabilizing the bolt 70 with respect to the slide 60. In the bolt extended position, bolt head 72 extends through and outward from opening 64 in slide plate 60. The opening 64 is intended to accommodate a variety of different sizes of bolt 70 for a variety of different latch apparatus embodiments, and may therefore have other shapes and sizes than what is illustrated in the drawings.

Figure 30:
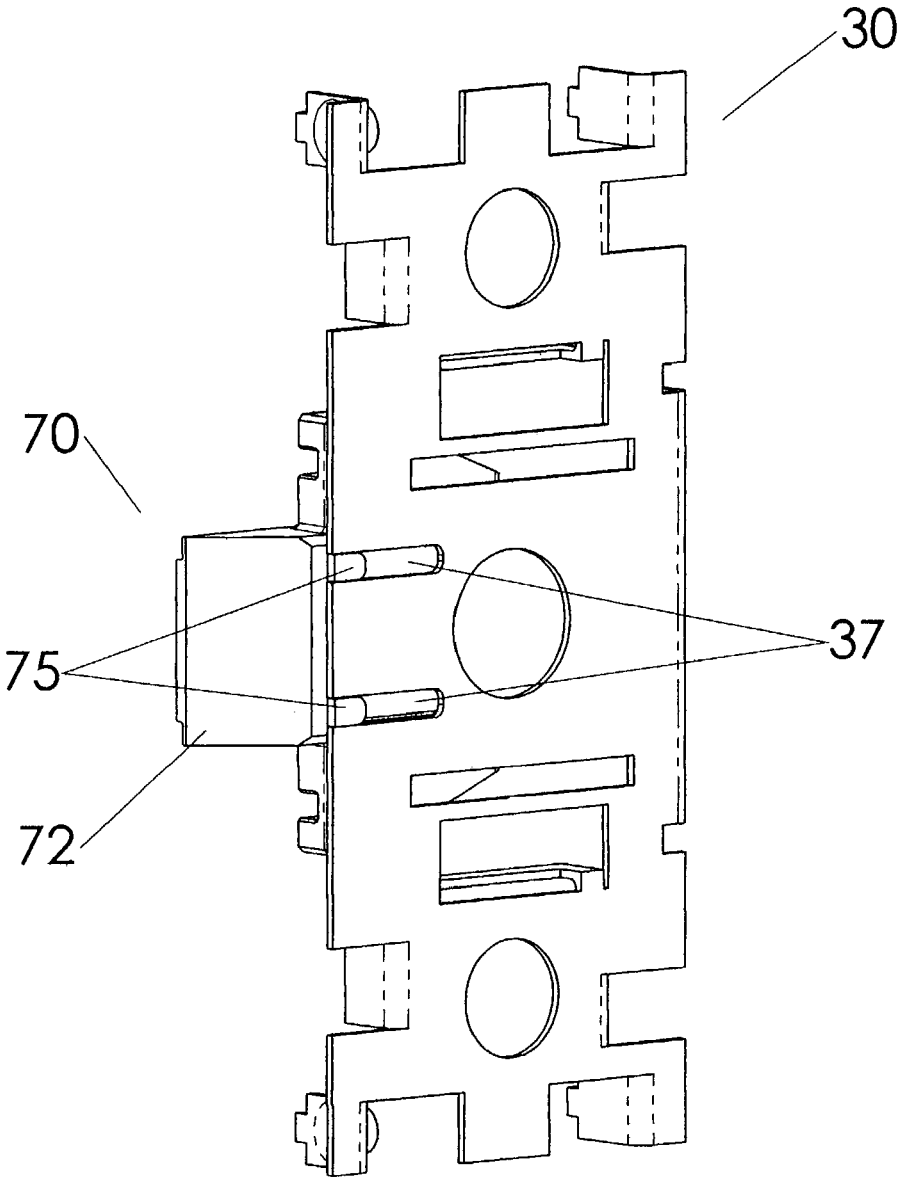
FIG. 30 is a perspective view of the bolt and base illustrating the engagement of the bolt guides and the base slots.

The wings 74 define channels 76 which interact with the lock plate 92 to control movement of the bolt 70 between its locked and unlocked positions. Guides 75 protrude from bolt 70 as shown in FIG. 29 and engage guide tracks 37 in base plate 30 (FIG. 30) permitting transverse movement of the bolt 70 with respect to the base plate 30. The "stroke" or length of movement of the bolt 70 can be controlled by modifying the length of the guide tracks 37.

Figure 28:
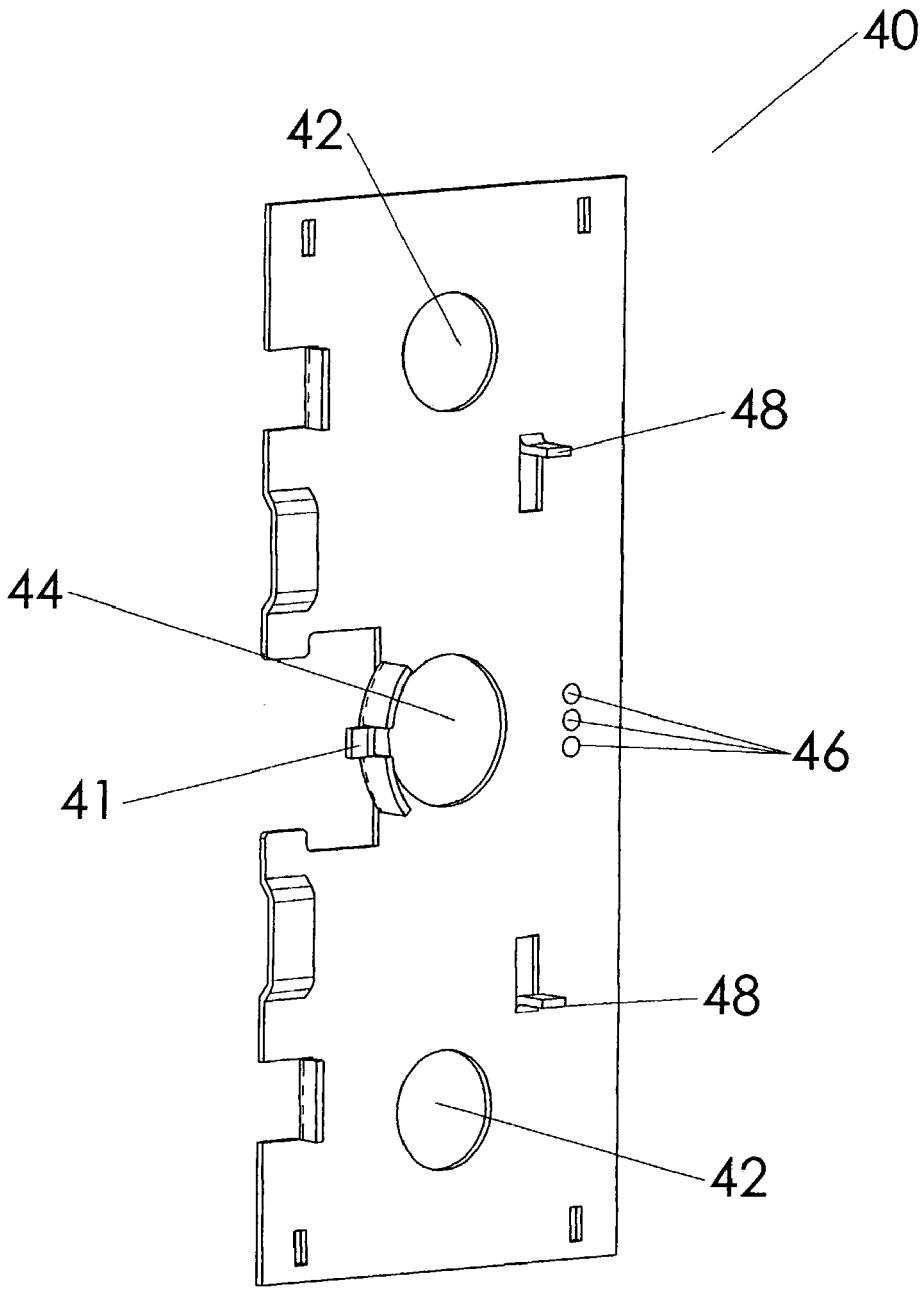
FIG. 28 is a perspective view of the cover plate.

Referring to FIG. 28, a bias mechanism, shown as spring 52, engages the bolt 70 and the tab 41 of the cover plate 40, when assembled, to bias the bolt 70 in its extended position. Although shown as a coil spring, spring 52 can be a leaf spring or any other mechanism for lightly biasing the bolt 70 in its extended position. It is preferable that the bias mechanism allow easy retraction of the bolt 70 into the "housing" of the mortise lock (defined by base plate 30 and cover plate 40) upon engagement with a strike plate mounted to a door jamb.

The slide springs 33 bias the slide 60 in the extended position. Bolt 70 can be retracted into the housing of the latch assembly 10 either by applying pressure directly to the bolt 70 (such as when the bolt engages the door jamb when rotated to a door closed configuration), or by rotation of the handle cam 80 by handles 22. This dual method of retraction of the bolt 70 allows the door to close and latch even when the, handles are not turned.

Figure 10:
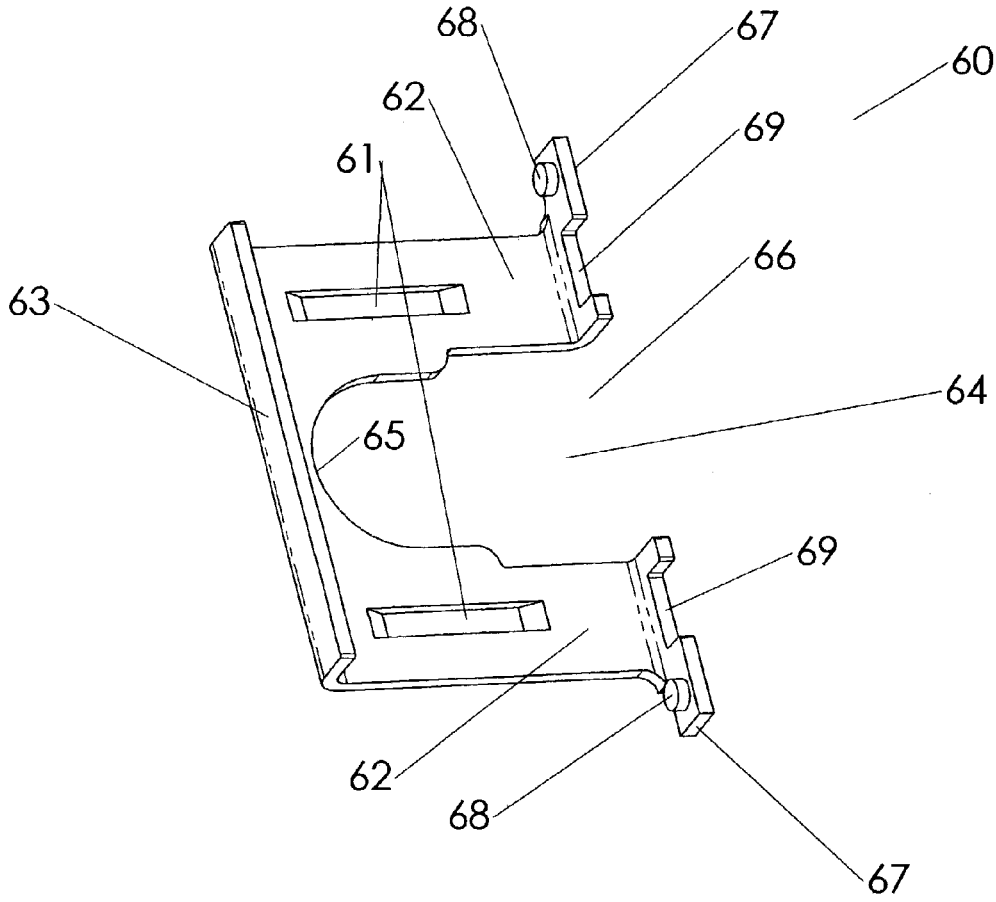
FIG. 10 is a perspective view of a slide utilized in the single bolt mortise lock.

Slide 60 has two legs 62 that define a U-shaped opening (slot 64) as illustrated in FIG. 10. The open end 66 of slot 64 permits slide 60 to be reciprocally moved between a "home" or extended position shown in FIG. 17 with slide 60 fully extended away from the base stop plate 35 and a retracted position as shown in FIG. 15, with strike plate 63 of slide 60 approaching or abutting stop plate 35. In the retracted position, slide 60 draws bolt 70 within the latch assembly 10. The closed end 65 of slot 64 may or may not abut the handle cam 80 when the bolt assembly 50 is in the extended (home) position. The handle cam 80 prevents the slide 60 from moving from its home position in a direction away from the base stop plate 35. Thus, slide 60 is limited to travel on only one side of the handle cam 80.

As illustrated in FIG. 10, formed on an end of the slide 60 opposite the strike plate 63 are retaining tabs 67 that engage and retain the bolt 70 when bolt 70 is biased in its extended position with respect to the base plate 30. These retaining tabs 67 include handle spring supports 68 for supporting slide springs 33 between the slide 60 and the spring supports 32 of base plate 30 as shown in FIG. 17. The bolt 70 is biased in the home or extended position as illustrated in FIG. 6 by the single, center mounted coil spring 52 (or some other equally suitable bias means) between the tab 41 on cover plate 40 and the bolt 70.

Figure 8:
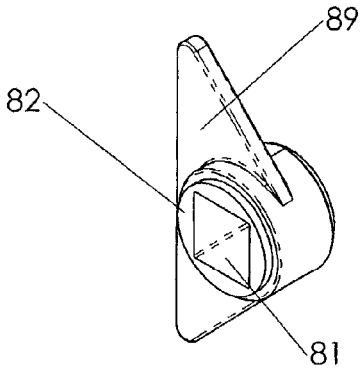
FIG. 8 is a perspective view of a handle cam utilized in the single bolt mortise lock.
Figure 9:
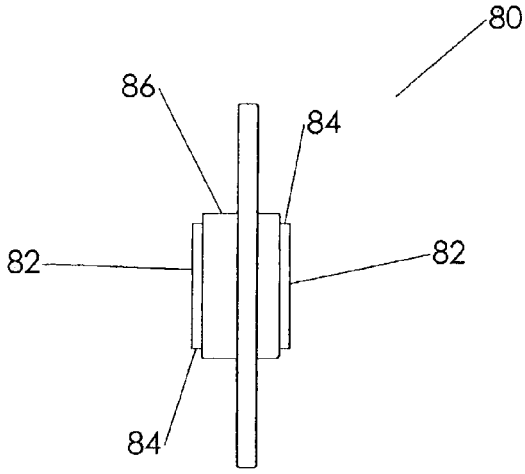
FIG. 9 is a left side view of the handle cam shown in FIG. 8.

As illustrated in FIGS. 8 & 9, the handle cam 80 is manufactured to form a mounting surface 84 and axle 86 as shown in FIGS. 8 & 9, and is rotatably mounted by each end 82 to and between the base plate 30 and cover plate 40. The handle cam 80 defines shoulders 89 which extend generally perpendicular from the rotational axis of the handle cam 80. The handle cam 80 further defines an opening 81 for receiving a handle spindle 83 attached to and extending from handle 22-O or 22-I. Opening 81 is configured to receive a square shaft in this embodiment, but may be configured to receive other shaft shapes such as a triangular or hexagon shaped shaft, or may even be designed to include a protrusion to which a handle can be attached.

In the illustrated embodiment, when the bolt 70 is in its extended position, both shoulders 89 engage the strike plate 63 of slide 60 as shown in FIGS. 13 and 17.

Upon rotation of the handle cam 80 in either a clockwise or counterclockwise direction, shoulders 89 engage the strike plate 63 of the slide 60, causing the slide 60 to move in the direction of the stop plate 35 on base plate 30. This movement of the slide 60 draws the slide 60 and bolt 70 from the extended position to a retracted position with the strike plate 63 substantially engaging the stop plate 35 of base plate 30, with bolt 70 pulled towards tab 41 on cover plate 40, compressing coil spring 52. Upon release of the force applied to handle cam 80 (by handles 20), handle cam 80 rotates back to its home position by the force of coil springs 33, with bolt 70 biased in its extended position by coil spring 52.

Figure 16:
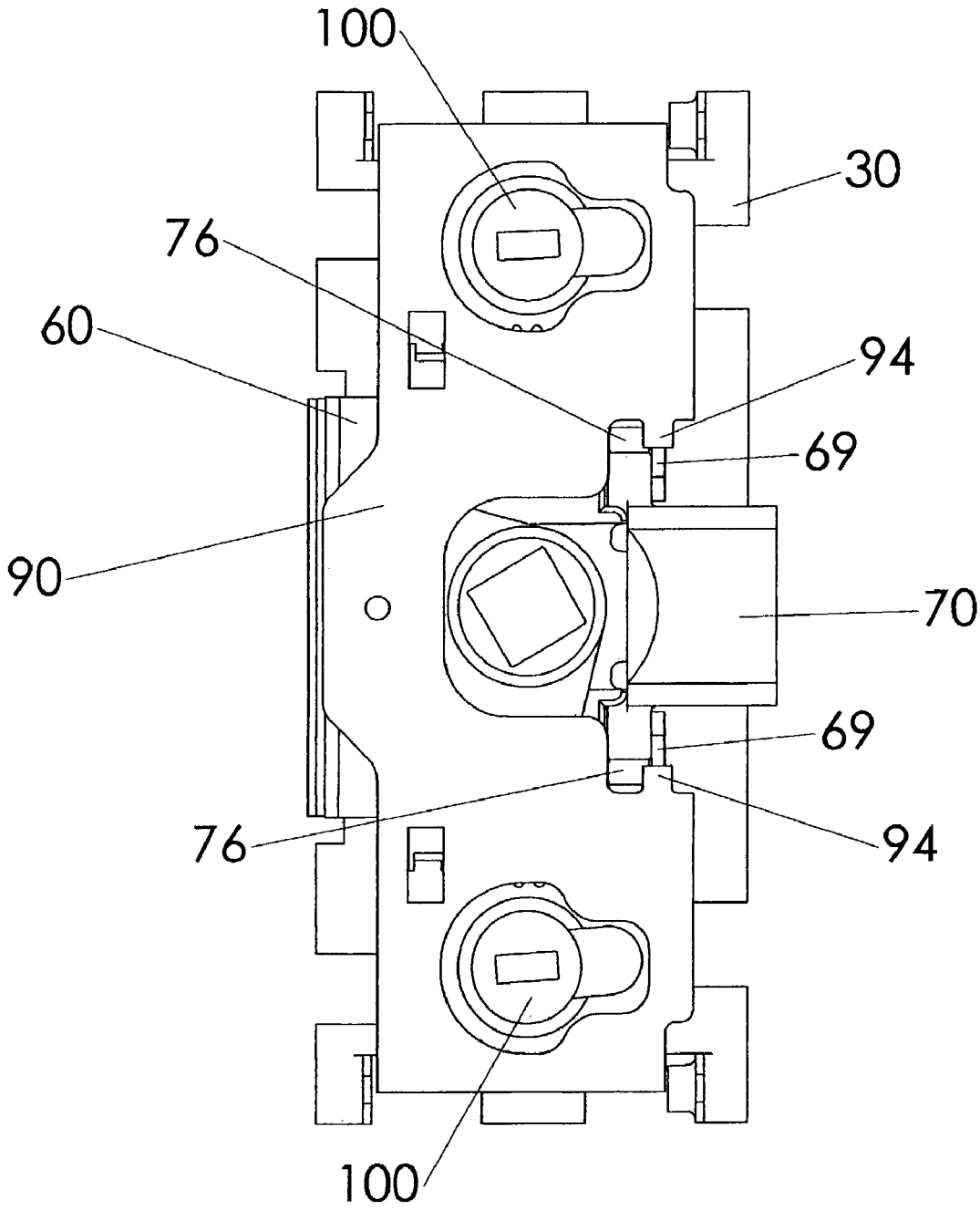
FIG. 16 is a side view of the single bolt mortise lock with the mortise plate and cover plate removed and the handle cam rotated into engagement with the slide, illustrating the alignment of the single bolt mortise lock slide, bolt and lock plate when the lock plate is in its unlocked position, and the bolt in its retracted position.

During actuation of the single bolt mortise latch assembly 10, the handle cam 80 will rotate through approximately a 30 to 45 degree arc as is shown in FIGS. 15 and 16. Rotation of the cam is limited by the travel of the slide 60 coming into engagement with the stop plate 35 on base plate 30.

Figure 11:
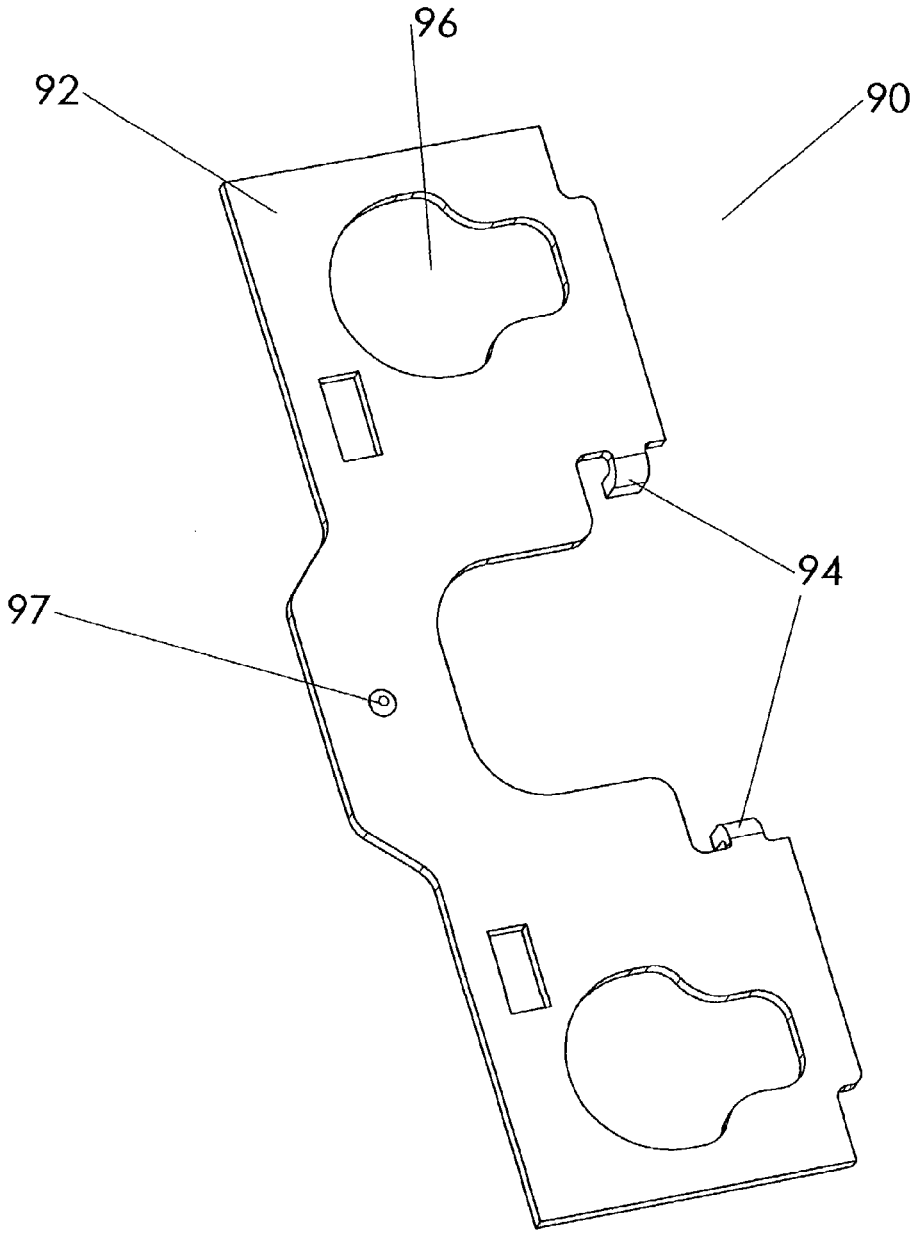
FIG. 11 is a perspective view of a lock plate utilized in the single bolt mortise lock.
Figure 18:
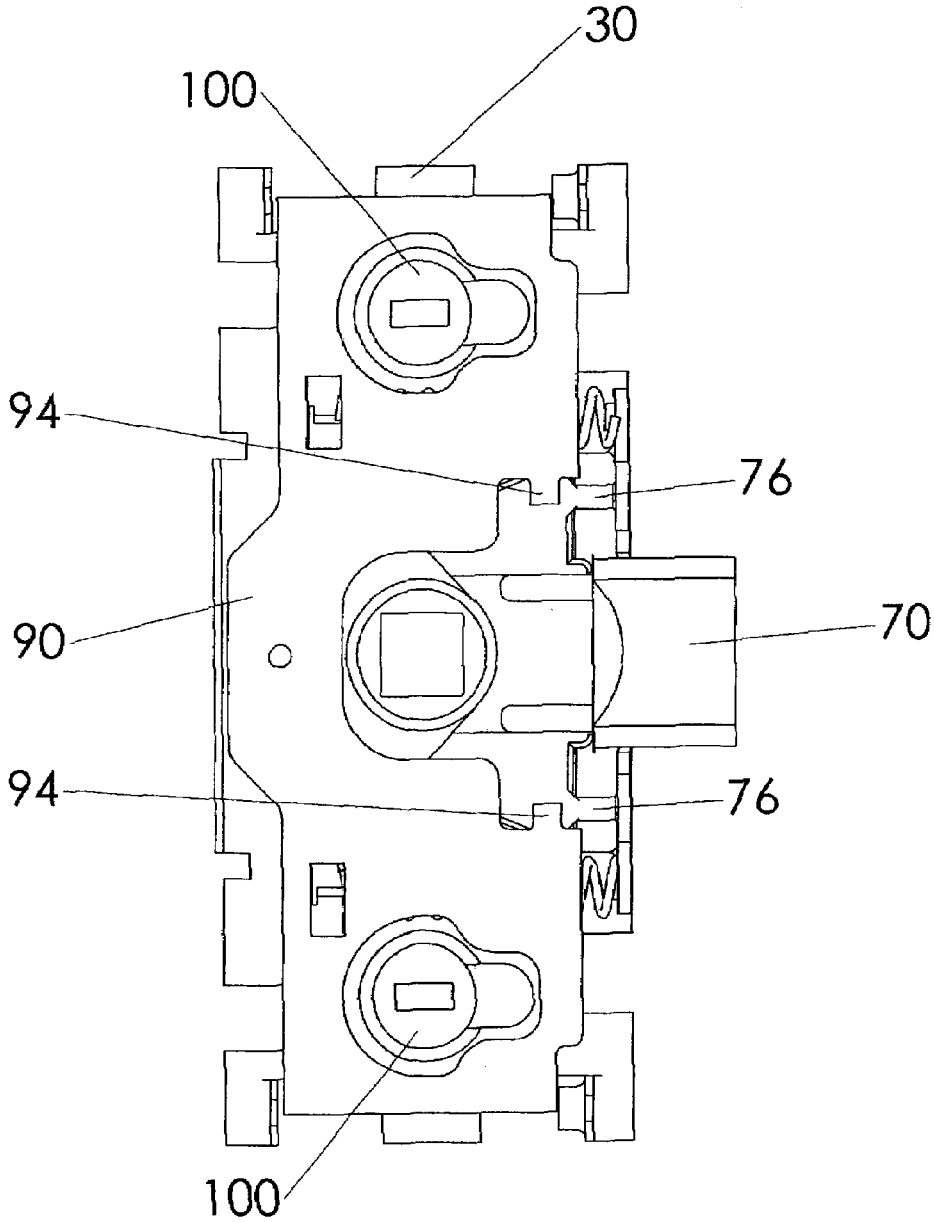
FIG. 18 is a side view of the single bolt mortise lock with the cover plate and mortise plate removed, with the lock plate in its unlocked position and the bolt in its extended position.
Figure 25:
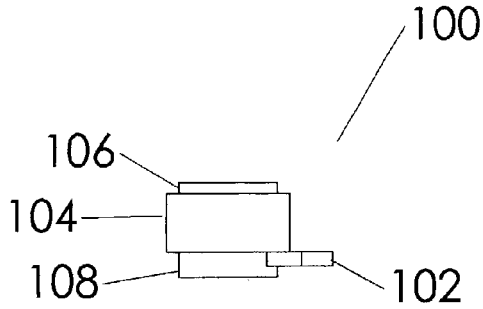
FIG. 25 is a top view of a key cam.

As illustrated in FIGS. 11 & 6, the lock plate assembly 90 includes a lock plate 92 and key cams 100 equipped with cam followers 102. The lock plate 92 is slideably mounted above the bolt 70 for optional bi-lateral movement transverse to the direction of travel of the bolt 70. The lock plate 92 includes two key cam openings 96 at each end of the lock plate 92 for receiving key cams 100. As illustrated in FIG. 25, key cams 100 define an axle 104 equipped with mounting surfaces 106 and 108 on each side so that they can be rotatably mounted to and between base plate 30 and cover plate 40 through key cam openings 96 in the lock plate 92. The bi-lateral movement of the handle and the dual key cams 100 make it possible for the single bolt latch key assembly 10 to be completely reversible for left or right hinged doors. The key cams are designed to receive either thumb turn buttons or key cylinders 2 at the installers discretion. The lock plate 92 includes lock tabs 94, and, a detent 97. When the bolt 70 is in its extended position, and the lock plate 92 is in its unlocked position as shown in FIG. 18, the lock tabs 94 align with cutouts 69 in slide 60 and channels 76 formed in bolt 70. In this orientation, the bolt 70 can be retracted either upon pressure being applied inwardly on the bolt 70 or by rotation of the handle cam 80.

When either key cam 100 is rotated, the followers 102 engage the lock plate 92 and move it up or down, transverse to the movement of the bolt 70, moving the lock plate 92 to its locked position, with the lock tabs 94 out of alignment with the channels 76 in bolt 70, preventing movement of the bolt 70 and/or slide 60. This converts the live bolt to a dead bolt assembly. See FIGS. 19 & 20, reflecting the locked position with the lock plate 92 moved "up or down" with respect to the floor when latch assembly 110 is mounted in the door 14, which direction of travel is transverse to the direction of travel of the slide 60.

Figure 12:
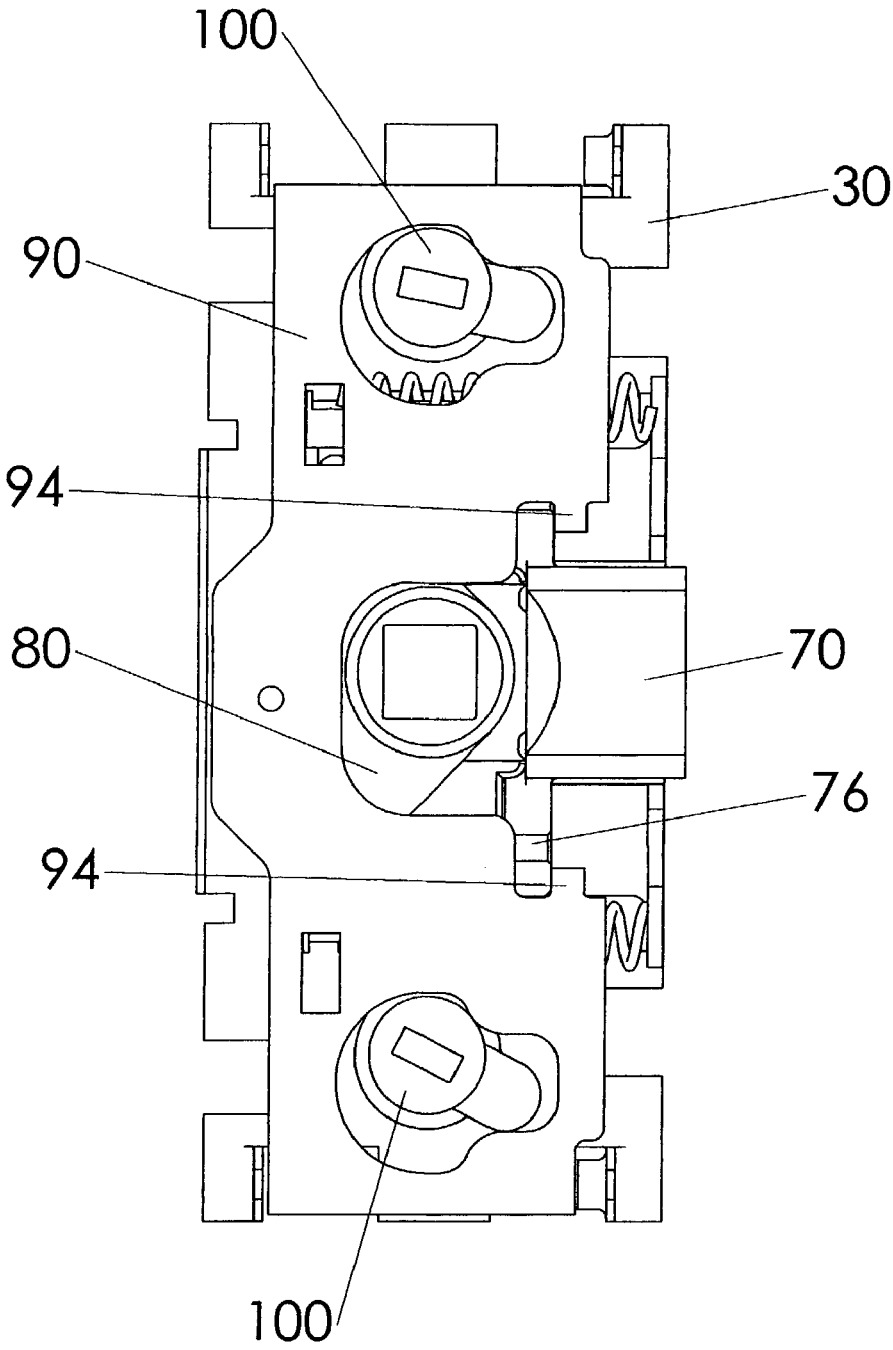
FIG. 12 is a side view of the single bolt mortise lock, with the cover plate removed, showing the alignment of the single bolt mortise lock components when locked in the retracted position.
Figure 14:
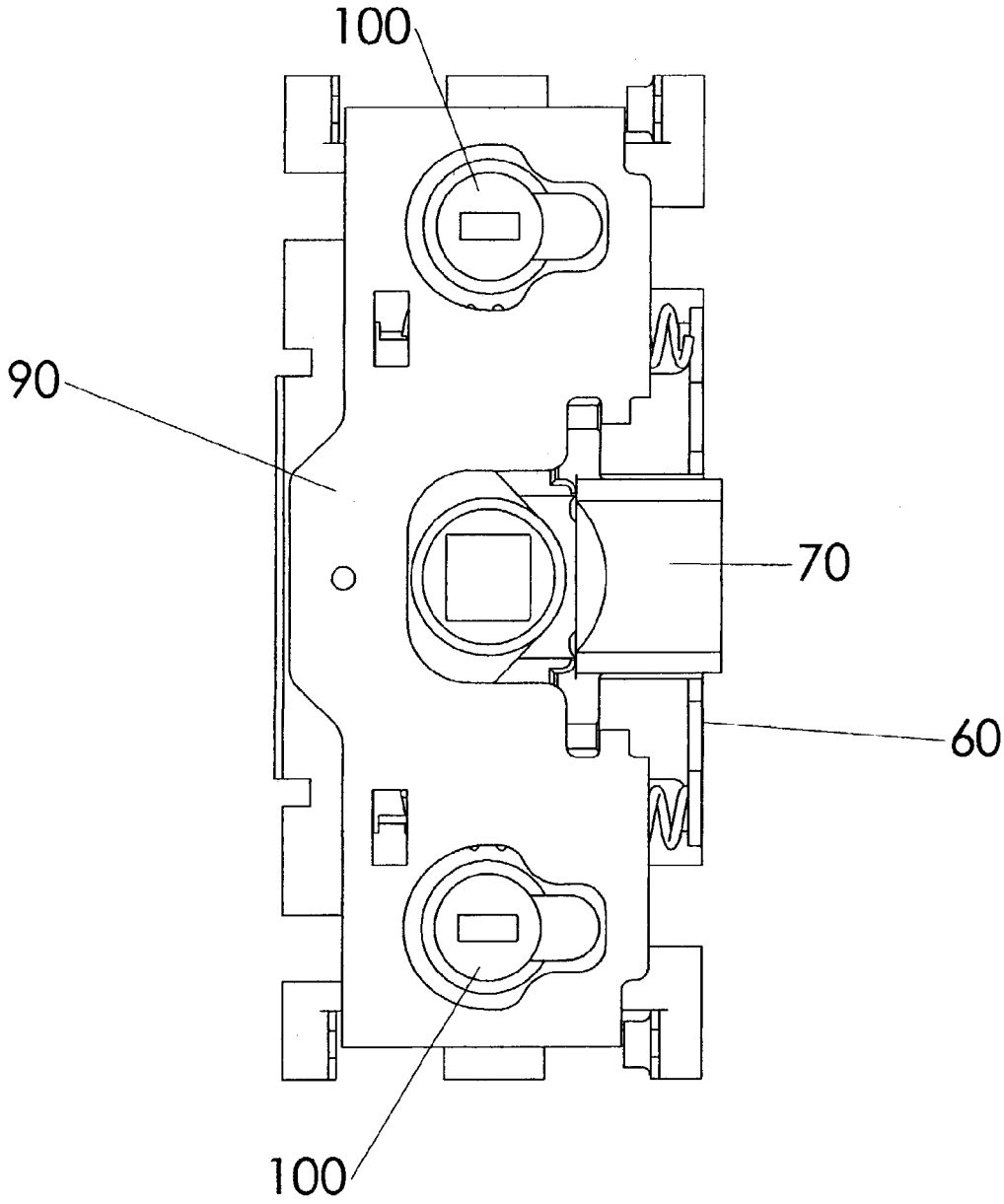
FIG. 14 is a side view of the single bolt mortise lock with the mortise plate and cover plate removed, illustrating the alignment of the single bolt mortise lock components when the bolt is in the retracted position.

It is also possible to lock the bolt 70 in an "always open" position as shown in FIG. 12. To place it in this configuration, the single bolt 70 is manually retracted into the mortise lock housing (between the cover plate 40 and base plate 30), and one of the key cams 100 is rotated so that the cam follower 102 engages the lock plate 92, forcing the lock plate 92 to move transversally with respect to the line of travel of bolt 70. Lock plate 92 is moved from its unlocked position, where lock tabs 94 are aligned with bolt channels 76 as shown in FIG. 14, to a position where lock tabs 94 are out of alignment with bolt channels 76 as shown in FIG. 12. This misalignment between the lock tabs 94 and channels 76 prevents bolt 70 from being re-extended beyond mortise plate 20.

As illustrated in FIG. 28, cover plate 40 defines key cam openings 42 and handle cam opening 44 for rotatably receiving the key cams 100 and handle cam 80, respectively. When cover plate 40 is assembled together with base plate 30, the openings defined in cover plate 40 are aligned with and mirror the shape, size and position of the corresponding openings in base plate 30, for receiving the handle cam 80 and key cams 100. The cover plate 40 further defines a series of indents 46 for engaging a detent 97 formed on lock plate 92. In the unlocked position, detent 97 engages the center indent 46. Upon movement of the lock plate 92 by key cams 100, detent 97 engages either of the outside indents 46 (because of the bilateral movement of the lock plate 92) and the lock plate 92 remains in its reset position until counter actuation by the key cams 100.

Figure 3:
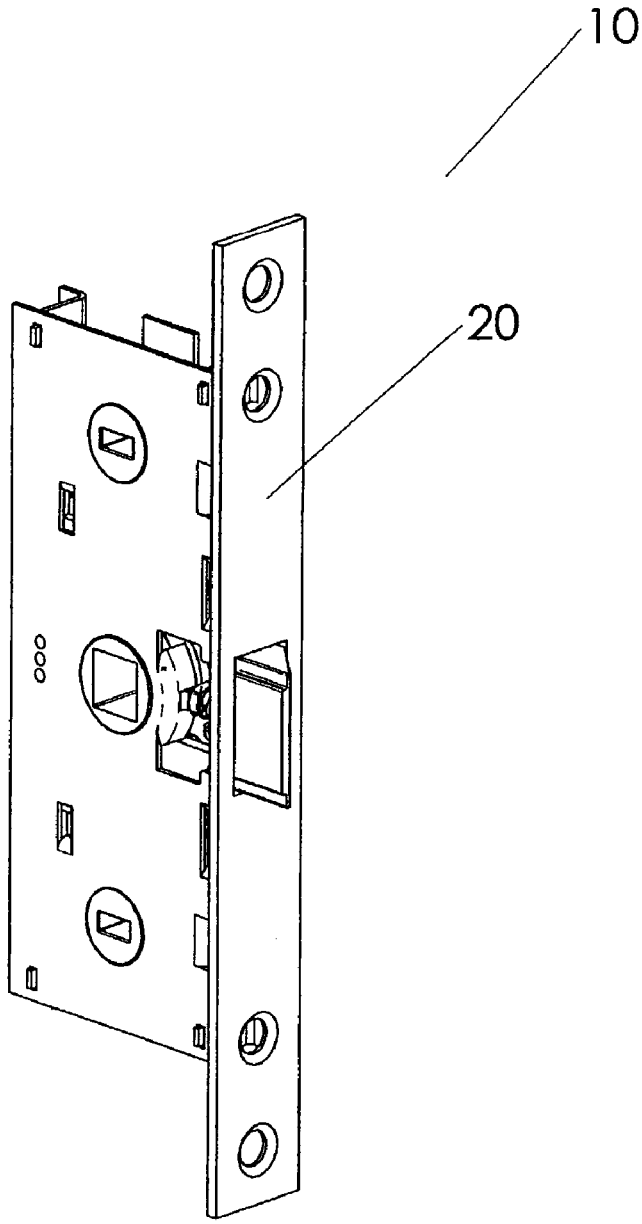
FIG. 3 is a perspective view of the single bolt mortise lock.

FIG. 3 best illustrates the fully assembled preferred embodiment of latch assembly 10, illustrating the positioning of rotatably mounted handle cam 80 and key cams 100 secured between the cover plate 40 and base plate 30, with the handle cam 80 located intermediate the key cams 100, and bolt 70 in its extended position. A more detailed review of the latch assembly 10 is necessary to illustrate the optional orientations available when using latch assembly 10.

There are three basic orientations for latch assembly 10:

1) always open (with the bolt fixed in its retracted position);

2) locked (with the bolt locked in its extended position); and 3) operational or unlocked (with the lock plate 92 in its unlocked position and the bolt 70 and slide 60 in their respective extended positions, permitting the door to be closed and then reopened by actuation of the handles 22).

There are two ways to fix the latch assembly 10 in its open position so the door 14 may always swing freely: 1) the bolt 70 is retracted manually and lock plate 92 is actuated to its locked position, with lock tabs 94 of lock plate 92 engaging the retaining tabs 71 of bolt 70; or 2) the bolt 70 is retracted by rotation of handle cam 80 which causes slide 60 to retract and draw bolt 70 into is retracted position, and lock plate 92 is then actuated to its locked position with lock tabs 94 of lock plate 90 engaging the retaining tabs 71 of bolt 70.

The latch assembly 10 may be secured in its locked position so the door 14 cannot be opened by rotation of either the handle cam 80. With the bolt 70 extended, rotation of key cam 100 in either direction will move the lock tabs 94 of lock plate 92 into engagement with retaining tabs 71 of bolt 72, preventing movement of the bolt 70.

With the present invention, lock out is prevented. The key cams 100 do not engage the bolt 70, only the lock plate 92. Protrusions 38 from cover plate 40 are aligned with openings 98 in the lock plate 92 to create a stop limiting the movement of the lock plate 92 upon rotation of key cams 100. Cams 100 also rotate in a closed path defined by cam openings 96 in lock plate 92. The stop arrangement in combination with the closed path defined by key cam openings 96 in lock plate 92 prevent separation of the cam follower 102 from proper engagement with the lock plate 92, and thus prevents the possibility of "lock out". Base plate 30 can also be configured with additional tabs extending from the base plate 30 to engage cam followers 102 at specified points in the rotation to further limit the rotation of key cams 100. With the present invention, if the required throw of the bolt 70 exceeds the depth of the bore in a door jamb for receiving the bolt 70, the lock mechanism 10 simply will not work until the door jamb is properly prepared. This prevents unknown failure of the lock mechanism.

With the present invention, it is easy to tell if the door is properly locked. From the inside of the door, the thumb turn button 2 will indicate if the door is locked. From the inside or outside of the door, the door handles 22 cannot be rotated when the latch assembly 10 is in the locked position.

Aesthetically, there is less hardware on the outside of the door than with conventional door locks, because the present invention boasts only a single bolt, whereas prior art mortise doors require a separate live bolt and dead bolt to perform the same functions. Door and jamb preparation is minimized. Further, the bolt 70 cannot be unintentionally retracted while the lock plate 92 is in its locked position.

Modification of various features of the components of the latch assembly 10 permit adjustability of the latch assembly 10 for functional advantage. For instance, by adjusting the width of the slide cutout 69, the bolt channel 76 and/or size of the lock tabs 94, various orientations of the latch assembly 10 may be achieved.

In the preferred embodiment, slide cutouts 69 are wider than bolt channels 76, and lock tabs 94 lie and are designed to move within the limitations defined by the width of slide cutouts 69. When handles 22 are rotated, the slide 60 retracts, drawing bolt 70 with it. When lock plate 92 is actuated to the locked position, lock tabs 94 are positioned within slide cutouts 69 yet engage the bolt 70, as shown in FIG. 12. This arrangement allows the slide 60 to return to its home or extended position, which allows handles 22 to rotate to their home position, but bolt 70 remains in its locked position.

Figure 31:
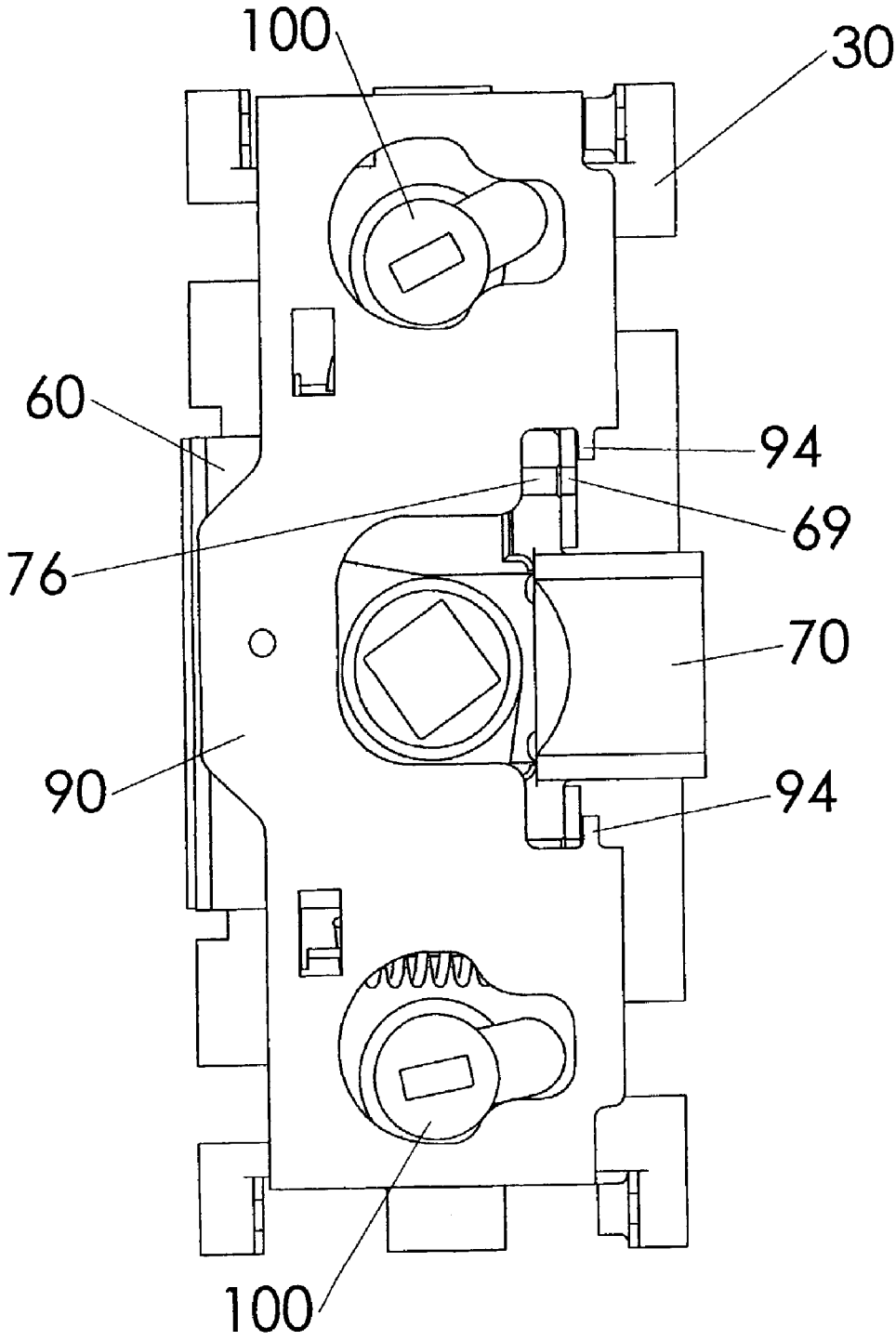
FIG. 31 is a side view of another preferred embodiment of the single bolt mortise lock with the cover plate and mortise plate removed, illustrating the engagement of the slide with a modified version of both the lock plate and slide in the always open position when the handles are in a "cocked" position.

In one alternate embodiment, as illustrated in FIG. 31, slide cutout 69 is narrower, approximately the same width as channel 76. Lock tabs 94 are also narrower and extend to the outside of slide 60 when in the extended position. When handles 22 are rotated, slide 60 is retracted, drawing bolt 70 into its retracted position. If lock plate 92 is actuated to its locked position, lock tabs 94 will engage the slide. 60, preventing movement (extension) of both the slide 60 and bolt 70, effectively locking the bolt 70 in its retracted or open door position, with handles 22 still in a turned or cocked position. Such an arrangement provides visual indication that the door is locked in an always open position.

Figure 19:
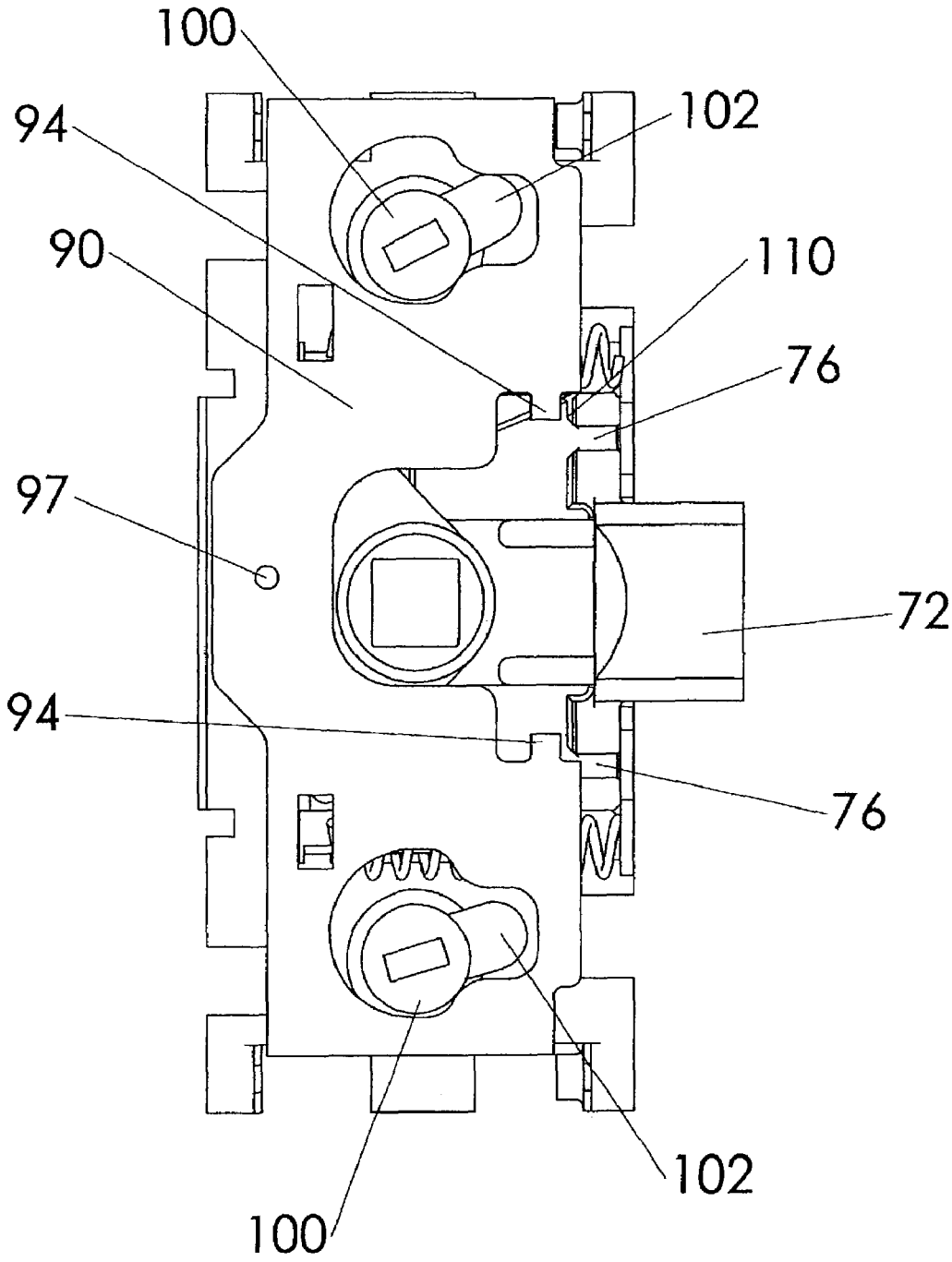
FIG. 19 is a side view of the single bolt mortise lock with the cover plate and mortise plate removed, with the lock plate in its locked upward position and the bolt in its extended position.
Figure 20:
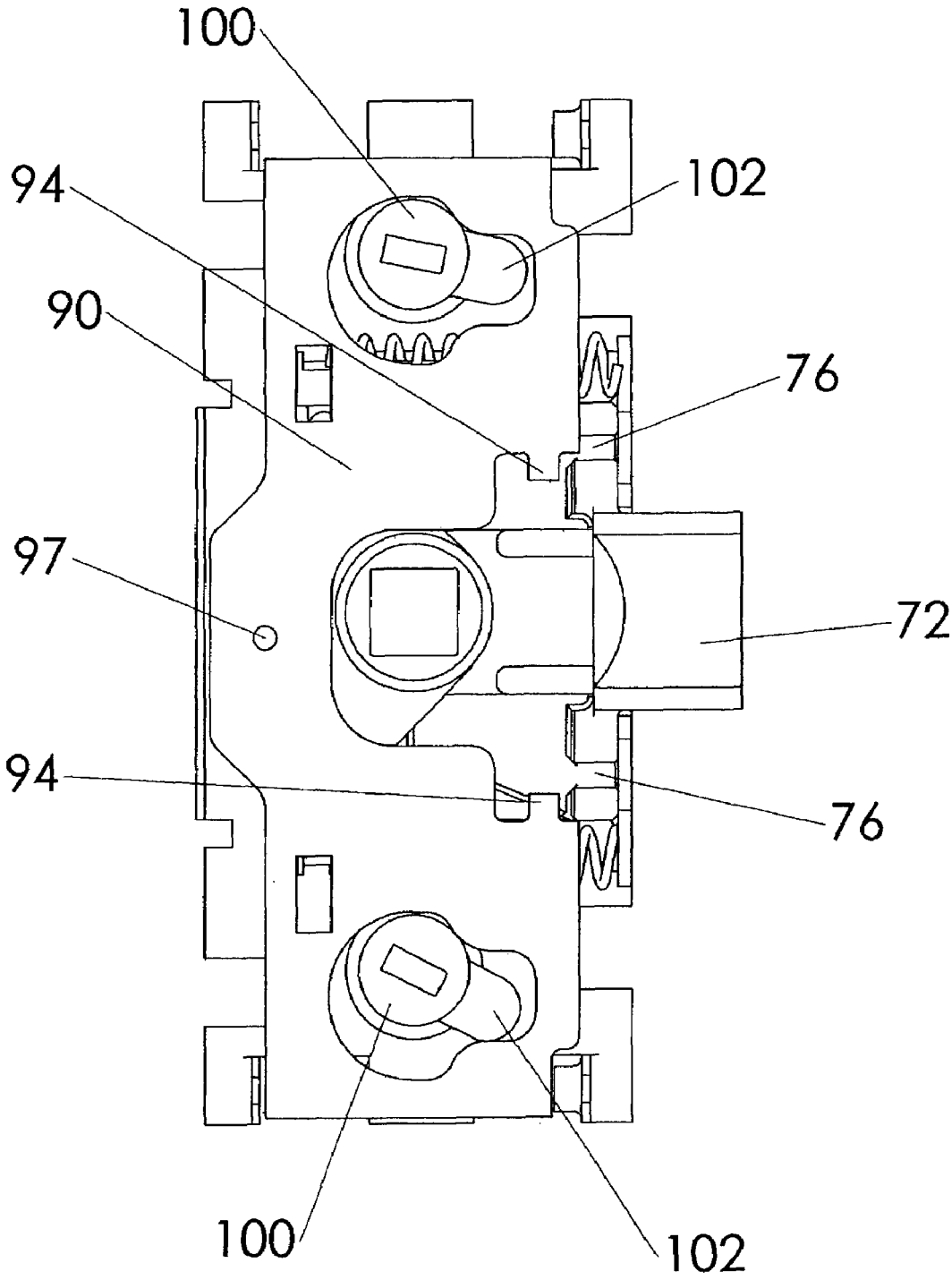
FIG. 20 is a side view of the single bolt mortise lock with the cover plate and mortise plate removed, with the lock plate in its locked downward position and the bolt in its extended position.
Figure 21:
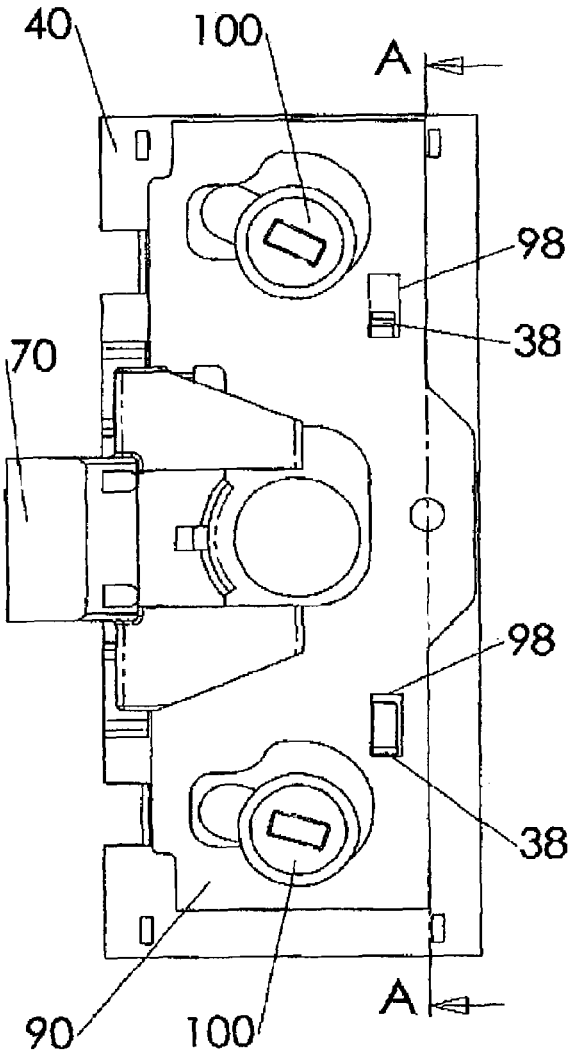
FIG. 21 is a side view of the single bolt mortise lock showing only the bolt, cover plate, key cams, and the lock plate.
Figure 22:
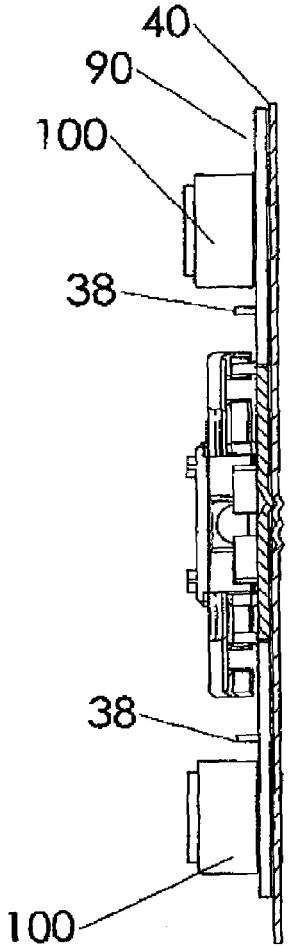
FIG. 22 is a section view A-A defined in FIG. 21 depicting the lock plate and cover plate detent connectivity.

In another embodiment, lock tabs 94 can be modified to create a gap 110 between engagement of the lock tabs 94 and bolt 70, as shown in FIG. 19, to provide flexibility in the throw or extension of the bolt 70. This adjustment permits the latch assembly 10 to be placed in the locked position even though there is less than full throw or extension of bolt 70 into a door jamb.

Numerous other adjustments may be made to adjust the throw of the bolt 70, including without limitation, adjusting the length of guide tracks 36 to adjust the movement of slide 60 with respect to the base plate 30; adjusting the length of guide tracks 37 and/or the size of guides 75 on bolt 70 to adjust the length of movement of bolt 70 with respect to slide 60; and adjusting the length of bolt wings 74 to engage the strike plate 63 of slide 60.

Figure 32:
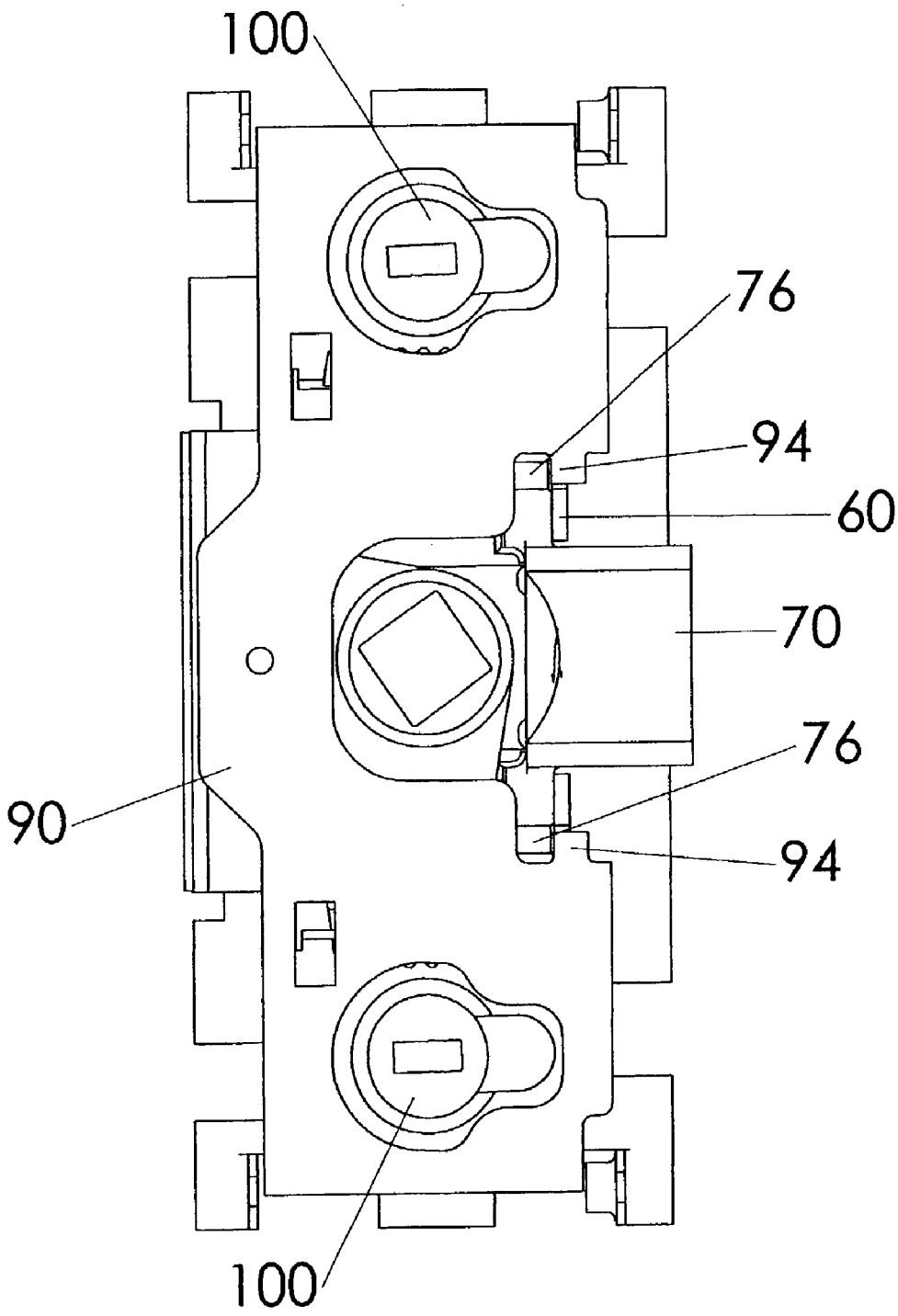
FIG. 32 is a side view of another preferred embodiment of the single bolt mortise lock with the cover plate and mortise plate removed, illustrating the engagement of a modified slide with the lock plate and bolt, preventing the always open position from being engaged when the handles are in a "cocked" position.

In another embodiment, slide cutouts 69 of slide 60 can be narrowed so that lock tabs 94 will lie within slide cutouts 69 when slide 60 is in the retracted position, as shown in FIG. 32. In this configuration, lock plate 92 is prevented from movement to the locked position and the "always open" position cannot be implemented when handles 22 are in the "cocked" position; however, the "always open" position can be implemented when the bolt 70 is retracted and handles 22 and slide 60 are in the home (extended) position because the lock tabs 94 will no longer engage the slide 60.

Figure 33:
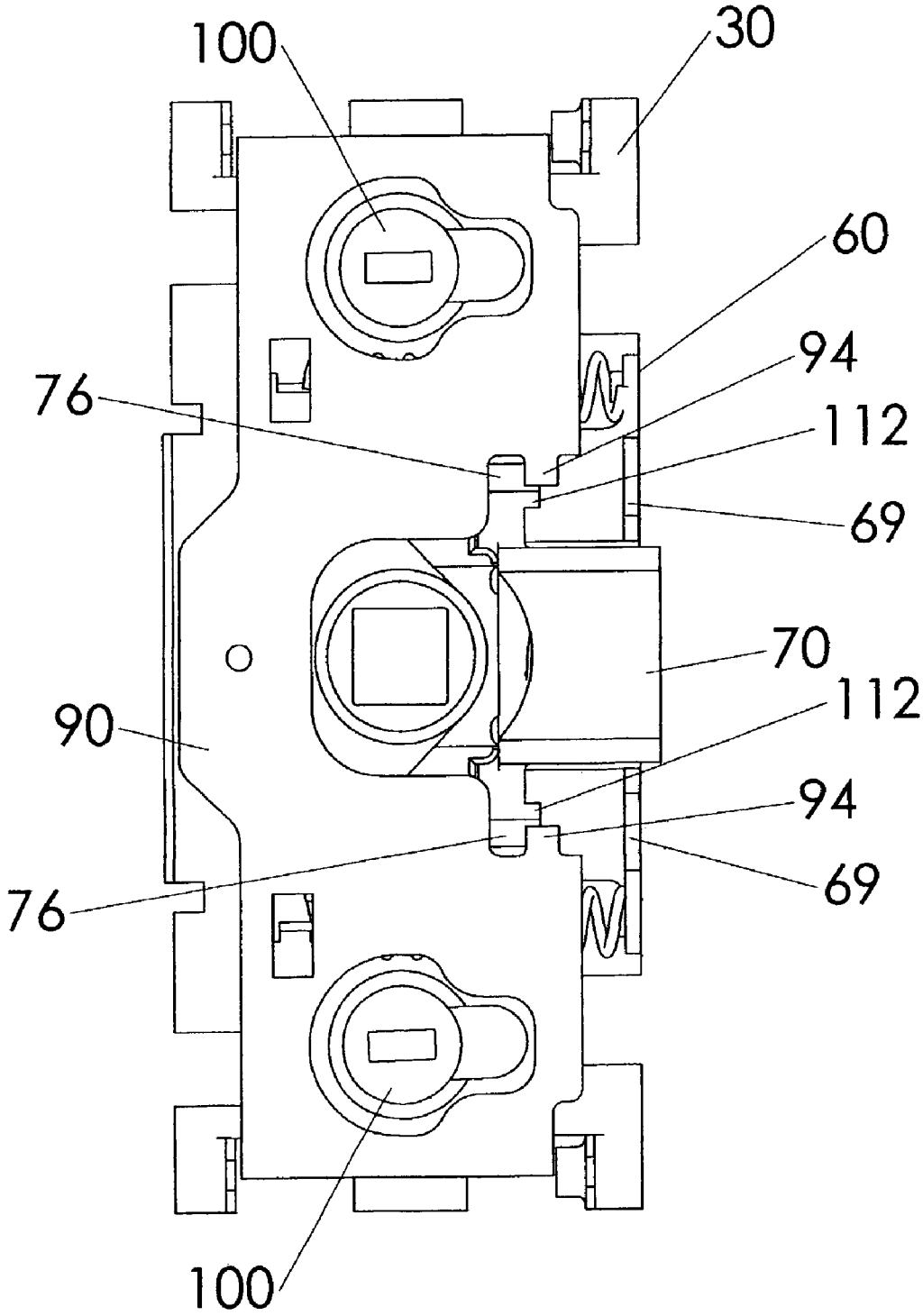
FIG. 33 is a side view of another preferred embodiment of the single bolt mortise lock with the cover plate and mortise plate removed, illustrating the engagement of the lock plate and bolt, preventing the always open position to be engaged.

In another embodiment, the bolt channels 76 can be extended as shown at 112 in FIG. 33, preventing the "always open" position from being engaged in any fashion.

It is anticipated that the lock plate assembly of the present invention can be utilized with other types of latch mechanisms, not just the rotary latch disclosed herein. For instance, the locking mechanism could be used with electric or slide actuated latches, both of which require movement of the bolt from a retracted position to an extended position. The lock plate assembly 90 is effective whenever it can be positioned to engage the bolt and prevent movement of the bolt between its retracted and extended positions.

The material from which the components of the latch assembly 10 may be created through a number of processes, including without limitation, stamping, die casting, forged parts, injection molding, etc., and may be made of various materials, including without limitation, metal and plastics, in any combination. For instance, the bolt 70 may be constructed of high impact strength metal, equipped with a plastic cap on the head 72 of bolt 70 for low friction engagement with a strike plate mounted in a door jamb.

I claim:

1. A single bolt mortise lock comprising:

a. a lock body;

b. a slide with lock plate engaging means, the slide being slideably mounted to the lock body for movement between a retracted position and an extended position;

c. a bolt with lock plate engaging means, the bolt being slideably mounted to the slide and actuated between an extended position and a retracted position upon movement of the slide or upon application of an external force on the bolt;

d. slide actuation means mounted to the lock body operatively engaging the slide for movement between the extended position and retracted position;

e. a lock plate including means for selectively engaging at least one of the bolt and slide lock plate engaging means, the lock plate being slideably mounted within the lock body for actuation between a locked position with the means for selectively engaging at least one of the bolt and slide lock plate engagement means blocking movement of at least one of the bolt and slide, and an unlocked position with the means for selectively engaging at least one of the bolt and slide lock plate engagement means permitting movement of the bolt between its retracted and extended positions; and f. plate actuation means mounted within the lock body for operatively engaging the lock plate for movement between its locked and unlocked position.

2. A single bolt mortise lock comprising:

a. a lock body;

b. a slide slideably mounted to the lock body for movement between a retracted position and an extended position;

c. a bolt having a channel defined along a longitudinal axis, the bolt being slideably mounted to the slide for longitudinal movement of the bolt upon actuation between an extended position and a retracted position upon movement of the slide or upon application of an external force on the bolt;

d. slide actuation means mounted to the lock body operatively engaging the slide for movement between the extended position and retracted position;

e. a lock plate including a lock tab for selectively engaging at least one of the bolt and slide, the lock plate being slideably mounted within the lock body for actuation between a locked position with the lock tab misaligned with the bolt channel to engage the bolt and block movement of the bolt between its retracted and extended positions, and an unlocked position with the lock tab aligned with the bolt channel to permit movement of the bolt between its retracted and extended positions; and f. plate actuation means mounted within the lock body for operatively engaging the lock plate for movement between its locked and unlocked position.

3. A single bolt mortise lock comprising:

a. a pair of side plates;

b. a slide including at least one lock tab slot slideably mounted to the pair of side plates for movement between a retracted and extended position;

c. a bias means mounted to the slide and pair of side plates for biasing the slide in the extended position;

d. an elongated bolt with at least one longitudinal lock tab channel extending therethrough, the bolt being slideably mounted to the slide with the lock tab channel aligned with the lock tab slot of the slide, and actuated between an extended position with the bolt extended from the pair of side plates and a retracted position with the bolt retracted into the pair of side plates;

e. a second bias means mounted to the pair of side plates and the bolt for biasing the bolt in the extended position until actuated by movement of the slide or application of an external force to the bolt;

f. slide actuation means mounted to the pair of side plates in operative interaction with the slide, for moving the slide between its retracted and extended position;

g. a lock plate including at least one lock tab slideably mounted within the pair of side plates for actuation of the lock plate between an unlocked position with lock tab(s) aligned with a corresponding lock tab channel of the bolt and a corresponding lock tab slot of the slide to permit movement of the bolt and slide with respect to each lock tab, and a locked position with each lock tab misaligned with at least one of its corresponding bolt lock tab channel and each corresponding lock tab slot of the slide to prevent movement of at least one of the bolt and slide; and h. plate actuation means mounted within the pair of side plates for moving the lock plate between its locked and unlocked position.

4. The mortise lock of claim 3 wherein:

a. the slide actuation means is a handle cam including a radial follower rotatably mounted to the pair of side plates; and b. the slide includes a strike plate configured so that upon rotation of the handle cam either clockwise or counterclockwise, the follower engages the strike plate to cause the slide to move from its extended position to its retracted position.

5. The mortise lock of claim 4 wherein the slide is substantially flat and the strike plate extends substantially perpendicular from the trailing edge of the slide, and the slide further includes an opening for a handle cam.

6. The mortise lock of claim 4 wherein the bolt mechanism includes a bolt head and a bolt support, the bolt support further defining a tab lock channel, the bolt support being slideably mounted on the slide with the lock tab channel aligned with the slide lock tab cutout for movement of the bolt mechanism between an extended position with the bolt head extended outward from a housing fonned by the side plates and a retracted position with the bolt head retracted within the housing formed by the side plates.

7. The mortise lock of claim 4 wherein the bolt mechanism includes a bolt head and two bolt supports, each bolt support defining a tab lock channel, the bolt supports being slideably mounted on the slide with the lock tab channel aligned with the slide lock tab cutout for movement of the bolt mechanism between an extended position with the bolt head extended outward from a housing formed by the side plates and a retracted position with the bolt head retracted within the housing formed by the side plates.

8. The mortise lock of claim 4 wherein the handle cam includes a follower such that upon rotation of the handle cam, the follower engages the strike plate of the slide to actuate movement of the slide between its extended and retracted positions.

9. The mortise lock of claim 4 wherein movement of the lock plate is substantially transverse to the direction of travel of the bolt and slide.

10. The mortise lock of claim 4 wherein the lock tab cutouts of the slide are substantially the same width as the lock tab channel of the bolt.

11. The mortise lock of claim 4 wherein the lock tab cutouts of the slide are wider than the lock tab channel of the bolt and the lock tab of the lock plate is designed to lie and move within the limitations defined by the width of the lock tab cutouts of the slide when in its extended position.

12. The mortise lock of claim 4 wherein the lock tab cutouts of the slide are the same width as the lock tab channel of the bolt and the lock tab of the lock plate extends to the outside of the slide leading edge when in the extended position.

13. The mortise lock of claim 4 wherein the lock tab of the lock plate travels in a plane spaced from and outside the leading edge of the slide, when the slide is in the extended position.

14. The mortise lock of claim 4 wherein:

a. the side plates define openings for a centrally located handle cam and two key cams located on opposite sides of the handle cam opening; and b. the lock plate has two lock tabs, two key cam openings and a handle cam opening cooperatively aligned with the key cam and handle cam openings of the side plates; and c. there are two key cams rotatably mounted between the side plates through the key cam openings of the lock plate, so that upon rotation of the key cam, the key cam engages the lock plate to move the lock plate between its locked position and unlocked positions.

15. The mortise lock of claim 4 wherein:

a. the side plates define openings for a centrally located handle cam and two key cams located on opposite sides of the handle cam opening; and b. the lock plate has two lock tabs, two closed path key cam openings and a handle cam opening cooperatively aligned with the key cam and handle cam openings of the side plates; and c. two key cams are rotatably mounted between the side plates through the key cam openings of the lock plate, so that upon rotation of the key cam, the key cam engages the lock plate to move the lock plate, bilaterally, dependent on the direction of rotation of the handle cam, between a central unlocked position and one of two laterally opposite locked positions.

16. The mortise lock of claim 3 wherein the plate actuation means is at least one key cam including a follower rotatably mounted to the pair of side plates, so that the follower engages and moves the lock plate between its locked position and unlocked position upon rotation of the key cam.

17. The mortise lock of claim 3 wherein the line of travel of the lock plate between its locked and unlocked position is substantially transverse to the line of travel of the bolt and slide.

18. A single bolt mortise lock comprising:

a. a pair of side plates;

b. a handle cam defining a follower and an orifice for receiving a handle spindle, rotatably mounted between the side plates;

c. a slide defining at least one lock tab cutout slideably mounted to a side plate and actuated between an extended and retracted position by the cam follower upon rotation of the handle cam;

d. a slide bias means mounted between a side plate and slide for biasing the slide in the extended position;

e. a bolt having at least one lock tab channel, the bolt being slideably mounted to the slide with each bolt lock tab channel in alignment with each slide lock tab cutout, for actuation between an extended and a retracted position upon movement of the slide or upon application of an external force on the bolt;

f. a bolt bias means mounted between the bolt and the cover plate for biasing the bolt in the extended position;

g. two key cams with followers rotatably mounted between the side plates on opposite sides of the handle cam;

h. a lock plate defining lock tabs and openings for receipt of the handle cam and key cams, slideably mounted between the side plates with the key cams and handle cam extended through their respective openings in the lock plate and rotatably mounted to the side plates, so that upon rotation of the key cams, the key cam followers engage the lock plate moving the lock plate between a locked position with the lock tabs in misalignment with the bolt lock tab channels and the slide cutouts to prevent movement of the bolt, and an unlocked position with the bolt lock tabs in alignment with the bolt lock tab channels and slide cutouts permitting movement of at least one of the bolt and slide with respect to the lock plate.

19. The mortise lock of claim 18 wherein movement of the lock plate is transverse with respect to movement of the slide.

20. A single bolt mortise lock comprising:

a. a lock body;

b. an elongated bolt with a longitudinal surface channel slideably mounted to the lock body for actuation between an extended and retracted position;

c. bolt actuation means mounted to the lock body for actuating the bolt between its extended and retracted position;

d. a lock plate with at least one lock tab slideably mounted within the lock body and actuated between a locked position with the lock tab misaligned with the bolt channel to prevent movement of the bolt, and an unlocked position with the lock tab aligned with the bolt channel to permit movement of the bolt;

e. plate actuation means mounted to the lock body for actuating the lock plate between its locked and unlocked position.

21. The single bolt mortise lock of claim 20 wherein:

a. the plate actuation means is at least one key cam mounted within the lock body for actuating the lock plate between its locked and unlocked position.

22. A mortise lock for installation within a mortise opening of a door, comprising:

a. first and second side plates, each having openings for a handle cam and at least one key cam, to define a lock housing;

b. a slide having a leading and a trailing edge, with at least one lock tab cutout defined along the leading edge and a strike plate defined along the trailing edge, the slide being slideably mounted between the side plates for movement between an extended and a retracted position;

c. a bolt mechanism including a bolt head and at least one retaining tab that defines a lock tab channel, the bolt mechanism being slideably mounted on the slide so that the retaining tab faces the leading edge of the slide and the bolt lock tab channel is aligned with the slide lock tab cutout, the bolt mechanism being slideably mounted for movement between an extended position with the bolt head extended outward from the housing formed by the side plates and a retracted position with the bolt head retracted within the housing formed by the side plates; and d. a handle cam with means for engaging a handle, rotatably mounted between the side plates in operative engagement with the slide, such that when the handle cam is rotated either clockwise or counter-clockwise, it engages the slide strike plate to actuate the slide between its extended and retracted positions; and e. a lock plate having at least one lock plate key cam opening and a handle cam opening for receipt of the each key cam and the handle cam, the lock plate being slideably mounted between the side plates with the lock plate key cam and handle cam openings aligned with corresponding openings in the side plates, for movement of the lock plate between a locked position with a lock tab misaligned with the lock tab channel of at least one of the bolt and the lock tab cutout of the slide to selectively prevent movement of at least one of the bolt and slide, and an unlocked position with the lock tab aligned within the lock tab channel of the bolt and the lock tab cutout of the slide to selectively permit movement of at least one of the bolt and slide; and f. the at least one key cam is rotatably mounted between the side plates through the lock plate, so that upon rotation of the at least one key cam, the at least one key cam engages the lock plate to move the lock plate between its locked position and unlocked positions.

23. The mortise lock of claim 22 wherein:

a. the lock plate includes a first engagement means; and b. one of the side plates includes a series of second engagement means aligned to engage the first engagement means of the lock plate to fix the position of the lock plate in its locked or unlocked position.

24. The mortise lock of claim 22 wherein:

a. the lock plate includes a detent; and b. one of the side plates includes a series of indents aligned to engage the lock plate detent to fix the position of the lock plate in its locked or unlocked position.

25. The mortise lock of claim 22 further comprising:

a. a stop means secured to any component other than the lock plate for releasably engaging the lock plate; and b. an engagement means on the lock plate for releasably engaging the stop means to fix the position of the lock plate.

26. The mortise lock of claim 22 wherein one side plate includes at least one stop tab extending there from for cooperative engagement with the key cam to limit rotation of the key cam.

27. The mortise lock of claim 24 wherein:

a. the slide includes at least one guide track; and b. the bolt mechanism includes rails that correspondingly engage the guide tracks of the slide to guide the bolt mechanism as it is moved between its retracted and extended positions.

28. The mortise lock of claim 24 wherein:

a. the slide includes two parallel guide tracks aligned with the direction of travel of the bolt; and b. the bolt includes a bolt member with a head and tail, and slide wings that extend laterally and back from the tail of the bolt, and b. the laterally extending slide wings define the lock tab channels of the bolt; and c. the backward extending bolt slide wings further define rails that engage the guide tracks of the slide to guide the bolt mechanism as it is moved between its retracted and extended positions.

29. The mortise lock of claim 22 wherein:

a. one side plate includes at least one guide track; and b. the slide includes at least one rail that engages the guide track of the side plate to guide the slide as it is moved between its retracted and extended positions.

30. The mortise lock of claim 22 wherein:

a. one side plate includes two parallel guide tracks aligned with the direction of travel of the slide; and b. the slide includes two parallel rails corresponding to the guide tracks of the side plate to guide the slide as it is moved between its retracted and extended positions.

31. The mortise lock of claim 22 further including:

a. a bias means mounted to and between the slide and a first side plate for biasing the slide in the extended position; and b. a second bias means mounted to and between a second side plate and the bolt for biasing the bolt in the extended position until actuated by movement of the slide or application of an external force to the bolt.

32. The mortise lock of claim 22 wherein:

a. the slide lock tab cutouts and the bolt lock tab channels are substantially the same width;

b. the lock tabs are dimensioned and positioned to engage the slide and prevent extension of the bolt when the slide is in the retracted position and the lock plate is in the locked position;

c. the lock tabs are dimensioned and positioned to travel in a plane substantially parallel with and spaced outside the bolt retainer tabs when the bolt is in its retracted position.

33. The mortise lock of claim 22 wherein:

a. the slide lock tab cutouts are wider than the bolt lock tab channels;

b. the lock tabs are dimensioned and positioned to engage the bolt but not the slide when the slide is in the retracted position, permitting the slide to return to the extended position but retaining the bolt in the retracted position.

34. The mortise lock of claim 22 wherein:

a. the slide lock tab cutouts and the bolt lock tab channels are substantially the same width;

b. when the slide and bolt are in the retracted position, the lock tab is positioned within the slide lock tab cutout and the slide lock tab cutout is dimensioned to prevent the lock plate from being moved to its locked position.

35. A single bolt mortise lock comprising:

a. a lock body;

b. a slide slideably mounted to the lock body for movement between a retracted position and an extended position;

c. a bolt having a lock tab defined along a longitudinal axis, the bolt being slideably mounted to the slide for longitudinal movement of the bolt upon actuation between an extended position and a retracted position upon movement of the slide or upon application of an external force on the bolt;

d. slide actuation means mounted to the lock body operatively engaging the slide for movement between the extended position and retracted position;

e. a lock plate including a channel defined therein for selectively mating with at least one of the bolt and slide, the lock plate being slideably mounted within the lock body for actuation between a locked position with the channel misaligned with the bolt lock tab and the lock plate engaging the bolt and blocking movement of the bolt between its retracted and extended positions, and an unlocked position with the lock tab aligned with the lock plate channel to permit movement of the bolt between its retracted and extended positions; and f. plate actuation means mounted within the lock body for operatively engaging the lock plate for movement between its locked and unlocked position.

* * * * *